United States Patent [19]

Springer

[11] 3,941,054

[45] Mar. 2, 1976

[54] STENCIL GRIPPING APPARATUS FOR A DUPLICATING MACHINE

[75] Inventor: Edward M. Springer, Chicago, Ill.

[73] Assignee: Heyer Inc., Chicago, Ill.

[22] Filed: May 13, 1974

[21] Appl. No.: 469,111

Related U.S. Application Data

[62] Division of Ser. No. 186,956, Oct. 6, 1971, Pat. No. 3,835,772.

[52] U.S. Cl. ..... 101/409; 101/415.1

[51] Int. Cl.[2] ..... B41F 1/28; B41F 27/06

[58] Field of Search ..... 101/415.1, 409, 127, 127.1, 101/128, 128.1, 132

[56] References Cited

UNITED STATES PATENTS

| | | | |
|---|---|---|---|
| 1,510,914 | 10/1924 | Barber | 101/409 |
| 2,220,265 | 11/1940 | Morrison | 101/132 |
| 2,249,313 | 7/1941 | Kropp | 101/132 |
| 2,453,927 | 11/1948 | Morse | 101/415.1 |
| 2,655,866 | 10/1953 | Linsley, Jr. | 101/415.1 |
| 2,689,521 | 9/1954 | Ritzerfeld et al. | 101/132 |
| 2,767,653 | 10/1956 | Babicz | 101/409 |
| 2,813,482 | 11/1957 | Mitchell et al. | 101/132 |
| 2,865,289 | 12/1958 | Fowlie et al. | 101/409 |
| 2,916,990 | 12/1959 | DuBois | 101/415.1 |
| 3,121,388 | 2/1964 | Benson | 101/415.1 |
| 3,664,260 | 5/1972 | Miller et al. | 101/132 |

OTHER PUBLICATIONS

IBM Technical Disclosure Bulletin, Vol. 15, No. 5, Oct. 1972, "Card Gripper for Rotary Press" by H. F. Hingstman, pp. 1406–1407.

*Primary Examiner*—Edgar S. Burr
*Assistant Examiner*—Paul J. Hirsch
*Attorney, Agent, or Firm*—McCaleb, Lucas & Brugman

[57] ABSTRACT

Duplicating machine having a drum rotatably mounted between a pair of side frames. Drum has a cylindrical wall having perforations communicating with an internal ink reservoir. An open mesh screen is stretched about the drum to provide an external cylindrical auxiliary reservoir immediately beneath an ink-distributing pad. Copy sheets are fed from a stack by adjustable pressure feed wheels and advanced along a path of movement to a first bight between a pair of forwarding rollers, and then to a second bight between an impression roll and the drum. Automatic apparatus is described for positively gripping a stencil sheet including provision for guiding the impression roll in non-interfering contact with the gripper assembly and for automatic alignment of the front edge of the stencil with the drum axis upon the positive clamping of the stencil sheet.

4 Claims, 30 Drawing Figures

Fig. 1
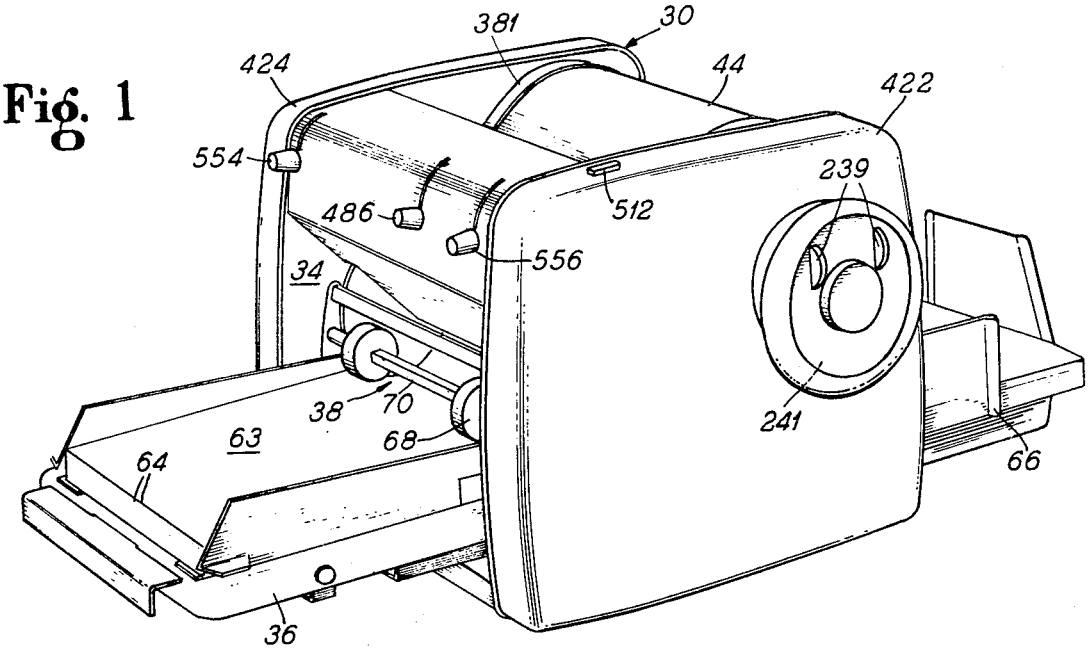
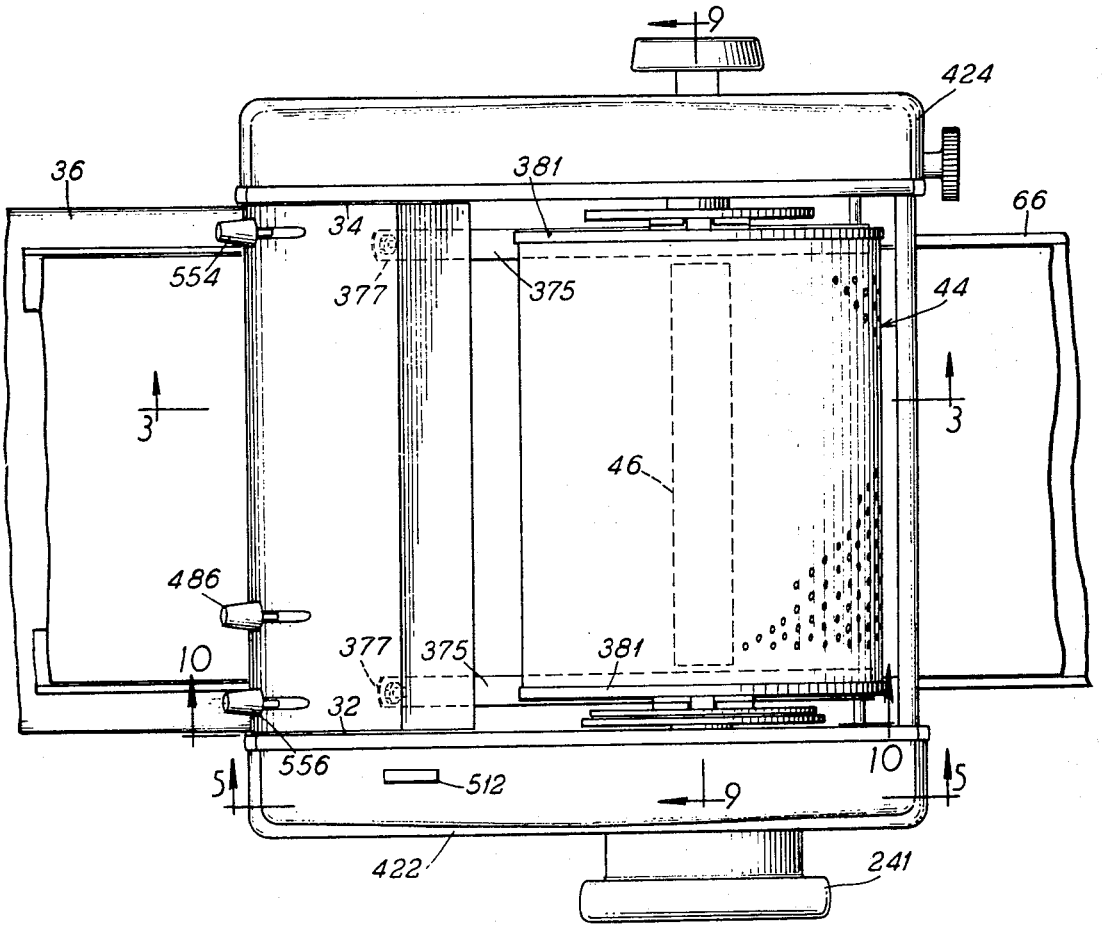
Fig. 2

Fig. 4
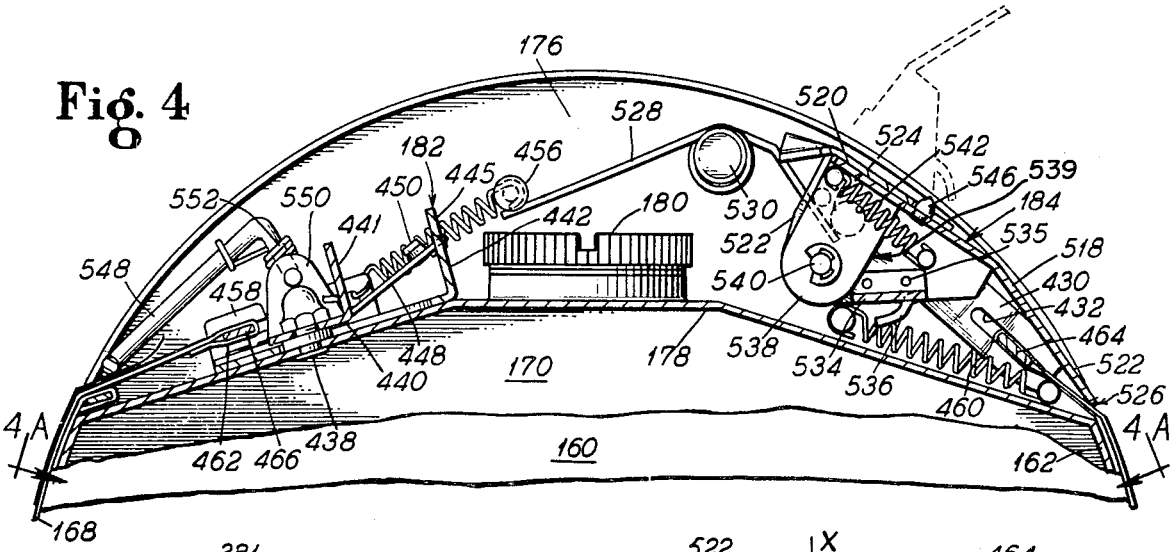
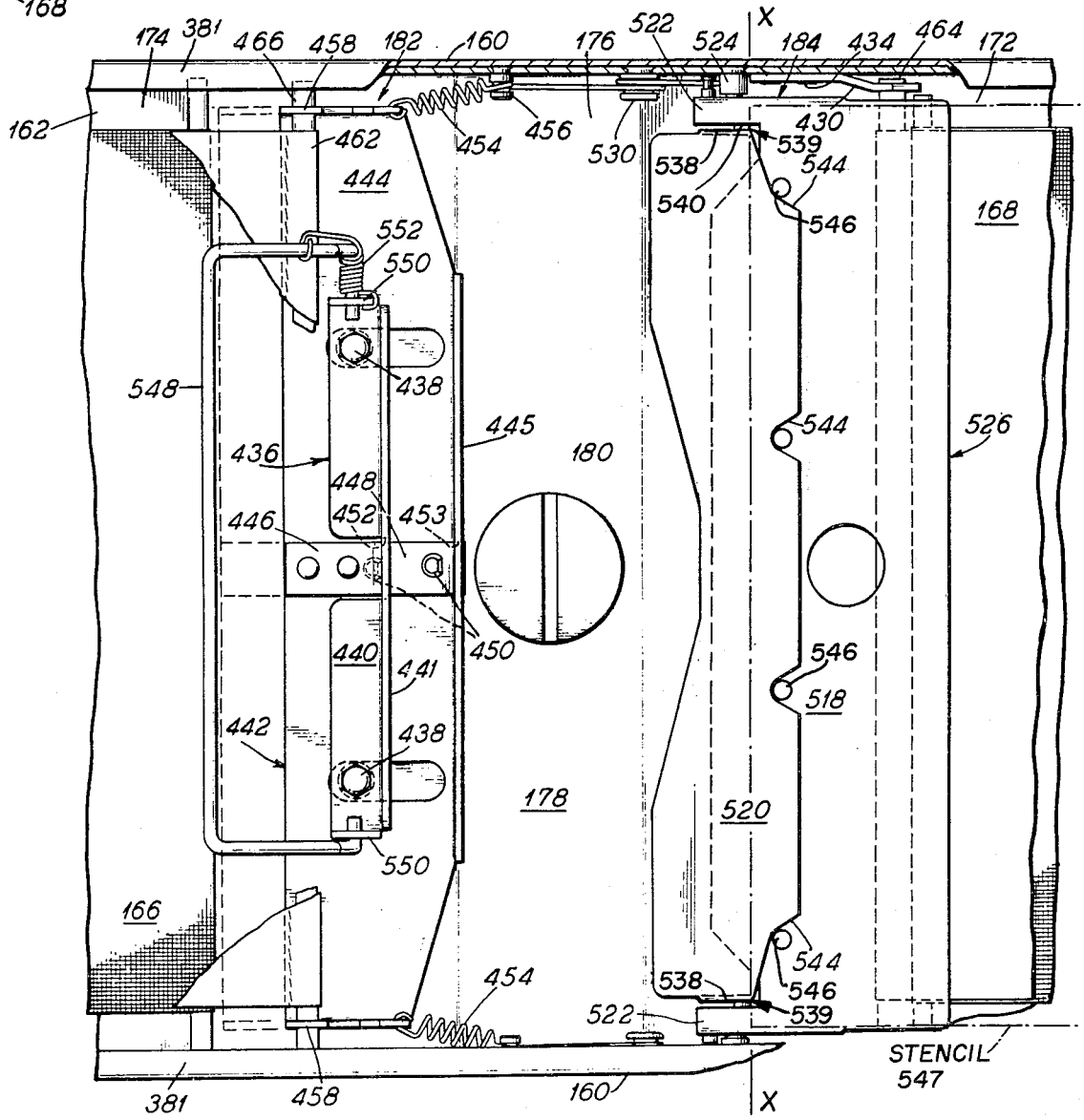
Fig. 4A

Fig. 7
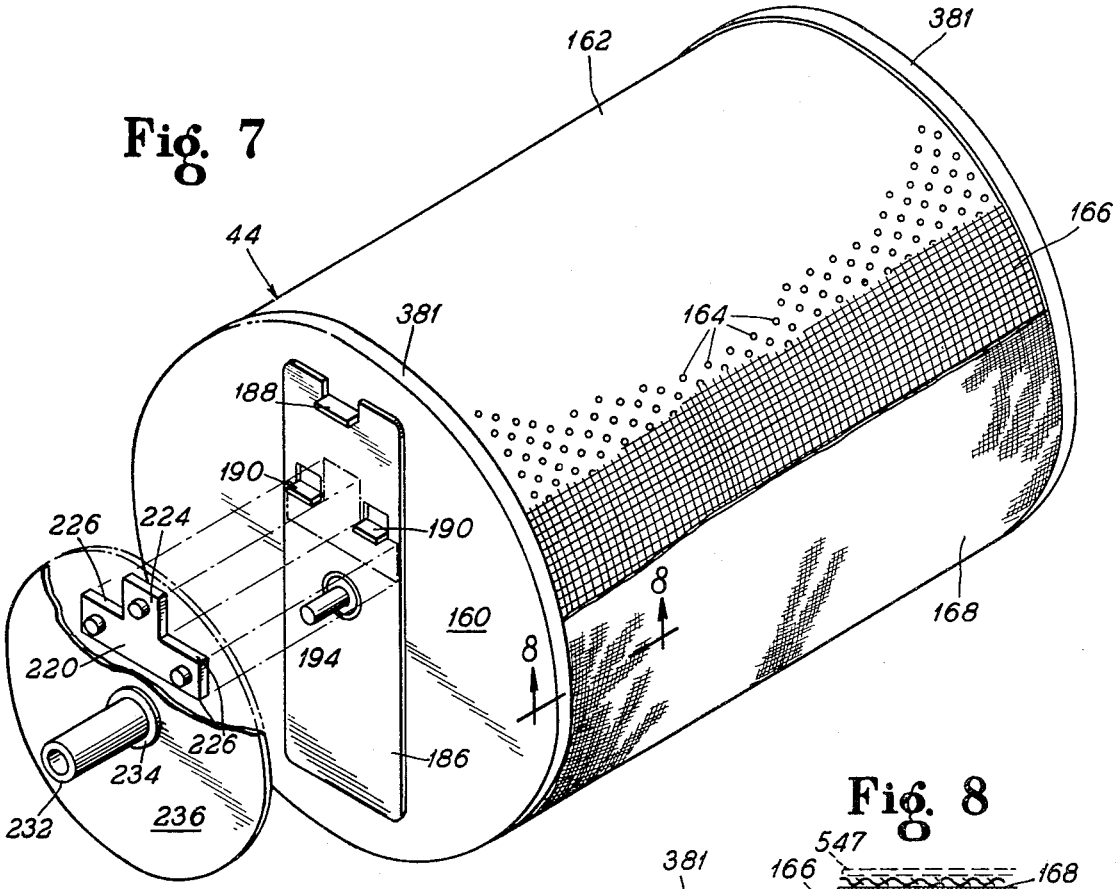
Fig. 8
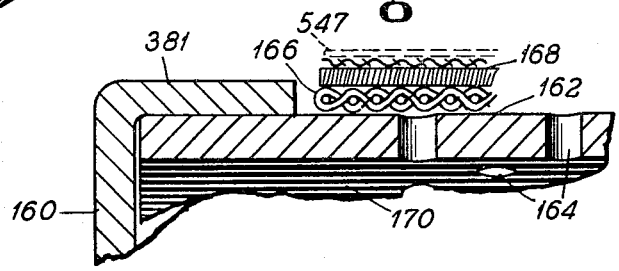
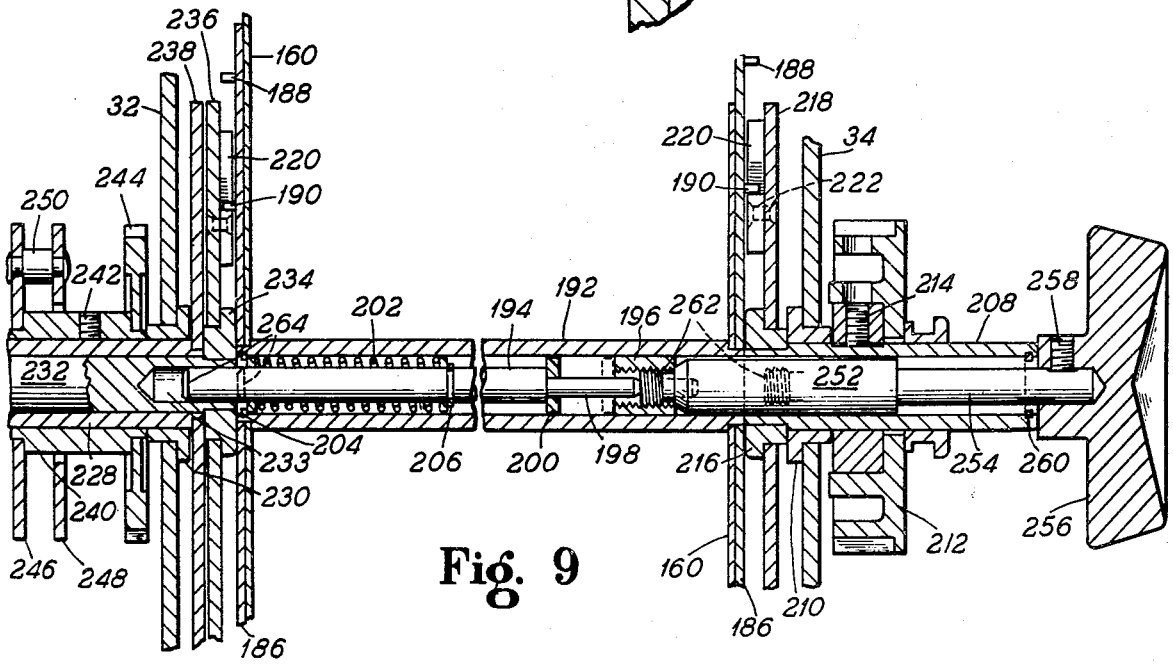
Fig. 9

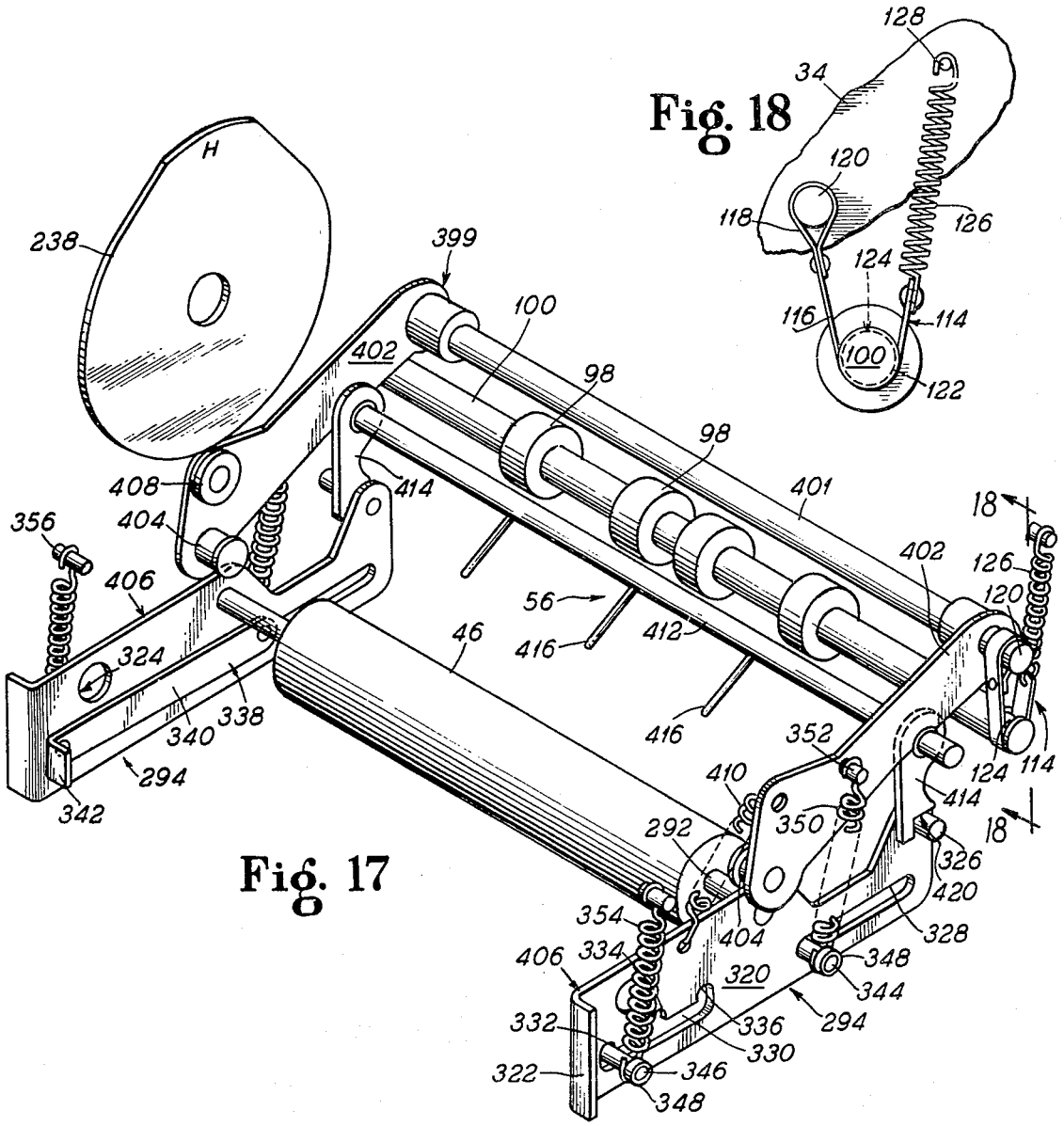
Fig. 18
Fig. 17
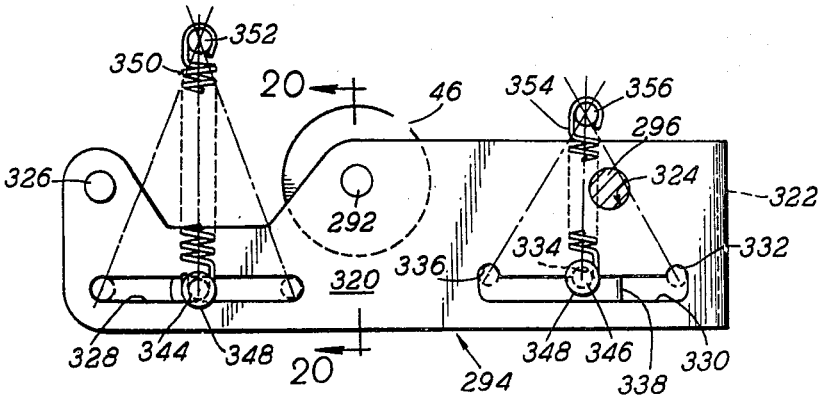
Fig. 19

Fig. 23
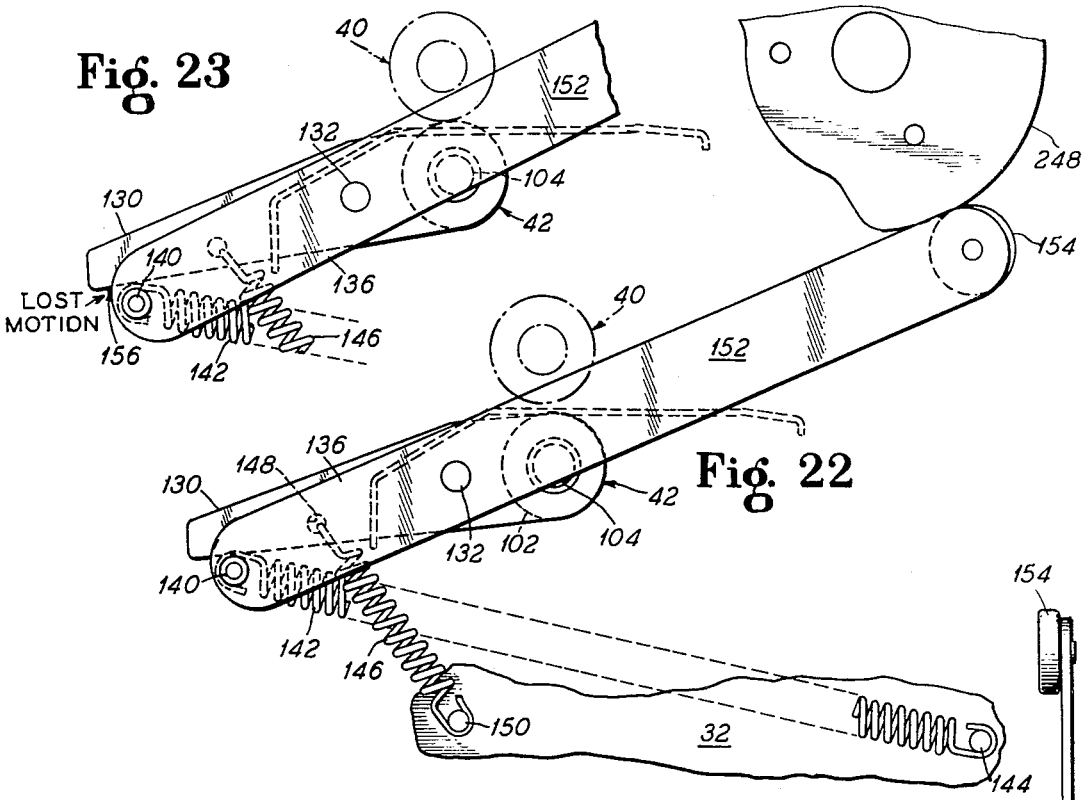
Fig. 22
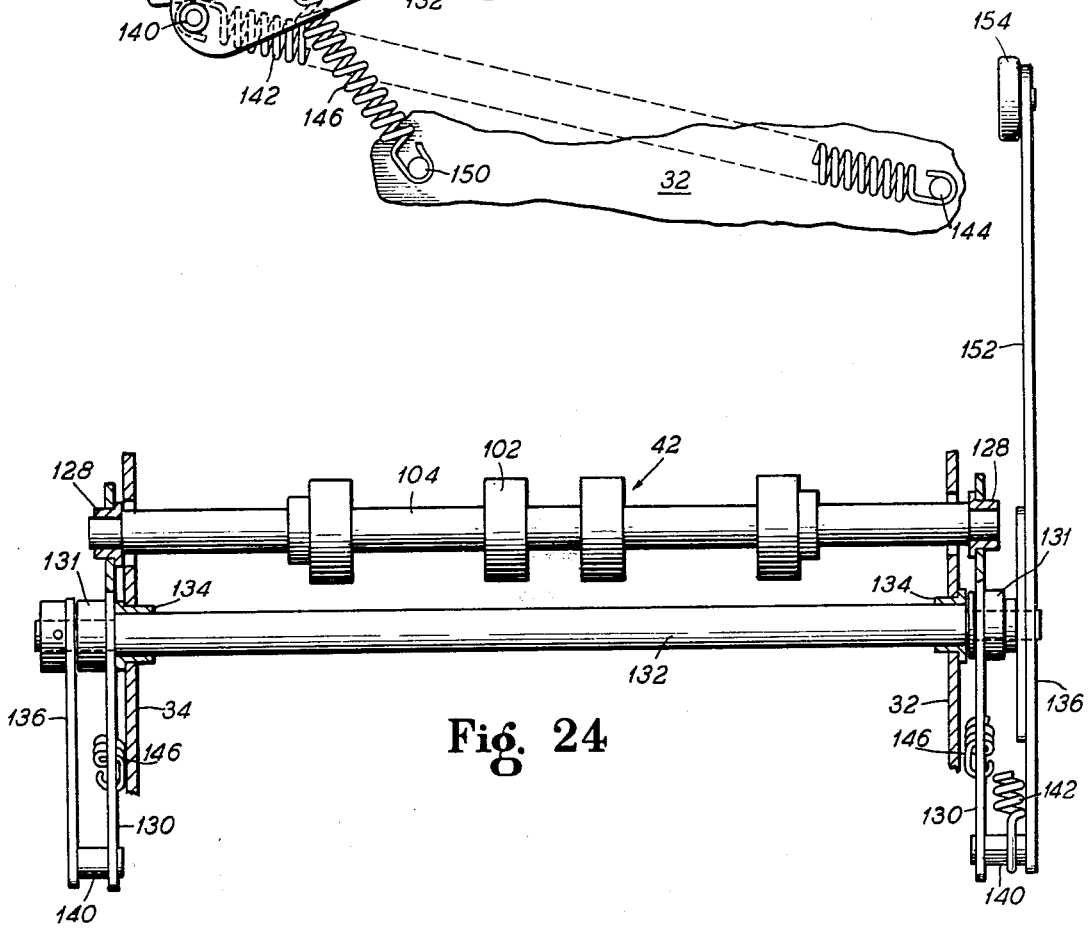
Fig. 24

STENCIL GRIPPING APPARATUS FOR A DUPLICATING MACHINE

BACKGROUND OF THE INVENTION

This application is a division of my copending application Ser. No. 186,956, filed Oct. 6, 1971 for DUPLICATING MACHINE now U.S. Pat. No. 3,835,772.

The field of the invention is generally that of ink-type duplicating machines in which ink is transferred from the interior of a drum, through an ink pad and a stencil carried by the drum, onto copy sheets.

In such machines the copy sheets are fed, one at a time, from a stack, through a bight between the drum and an impression roll which presses the sheet against the stencil as it is drawn through the bight. The impression roll must not be pressed against the ink-covered stencil or it will smear the stencil and transfer ink to the backs of succeeding sheets. Mechanism must therefore be provided for preventing contact between the impression roll and the stencil when no sheet is fed to the drum. Providing such mechanism is complicated because the presence of a relatively fragile copy sheet must be sensed to trigger the very substantial forces required for moving the impression roll to press the copy sheet against the stencil. A further complication is that modern duplicating machines must produce more than 100 copies per minute, so there is very little time for the impression roll to be moved after sensing the presence or absence of a sheet.

Machines of the type with which the present invention is concerned feed sheets in two separate movements with a definite stop or pause between them. There is an initial movement of the sheet from the stack, followed by a final movement across the drum. It is important that this initial movement be stopped at a definite point and at a definite time correlated with the rotation of the drum, to properly register the printing on the sheet. Prior machines have not precisely controlled such stopping and starting of the sheets resulting in a loss of precision in the printed copy.

A problem, sometimes called "dotting" develops in conventional duplicating machines at high speeds, resulting for all practical purposes in an upper speed limit which will not produce acceptable copy. Conventional duplicating machine drums have a cylindrical peripheral wall with perforations through which the ink flows to a pad, and thence to the stencil. At high speeds, ink flows more readily to the stencil portions over the perforations than to the portions between, giving an uneven or dotted pattern to the printing.

Stencils vary in their ability to transmit ink, so it is necessary to provide some mechanism for adjusting the pressure between the impression roll and drum during printing.

The duplicating machines are relatively complicated, having many parts which must be kept clean and in good operating order by regular maintenance procedures. For this purpose it is important that the drum be easily removable to provide access to parts beneath it.

Stencils commonly have a backing sheet which acts as a cushion during typing, and provides convenient means for handling as when assembling the stencil on a drum. After the stencil is so assembled, the backing sheet is removed. Some stencils have a perforated line near the head portion along which the backing sheet may be torn off. Others, such as certain electronic stencils, do not have such a perforated line and the operator has to tear the backing sheet along a ruler or other separate straight edge tool held against the drum. This is not completely satisfactory because the operator must hold the tool by one hand, aligned by eye, and the resulting torn edge is often crooked.

SUMMARY OF THE INVENTION

A principal object of the invention is to provide an ink-type duplicating machine which functions with precision at high speeds and can be manufactured in volume at a reasonable cost.

Another object is to provide a drum with a stencil clamp having a built-in knife edge for removing the backing sheets from certain types of stencils.

Another object is to provide a duplicating machine in which an ink pad and stencil can be replaced, and an entire drum can be exchanged, as for instance during multi-color printing, quickly and easily, without soiling the hands of the operator.

A specific object is to provide a pivotal main clamp or take on plate overlying an ink pad at the leading end of the cylindrical printing surface of the drum, with a series of external stencil-retaining members engaging apertures in the head end of a stencil; and a pivotal auxiliary clamp or stencil plate overlying such stencil-retaining members to hold the head end of the stencil in place and keep it ink-free for "clean hands" stencil replacement after a printing run.

Other objects and advantages will be apparent from the following description taken in connection with the drawings in which:

BRIEF DESCRIPTION OF THE DRAWINGS

FIG. 1 is a perspective view of a machine illustrating the present invention, the figure showing side ornamental plates or covers which enclose certain operative parts of the mechanism;

FIG. 2 is a partial plan view of the machine shown in FIG. 1;

FIG. 4 is an enlargement of a portion of FIG. 3;

FIG. 4A is an external fragmentary view of the drum as seen in the direction of arrows 4A—4A in FIG. 4;

FIG. 7 is a perspective view of the printing drum and some associated parts removed from the machine;

FIG. 8 is an enlarged fragmentary cross-sectional view of FIG. 7 taken along the line 8—8;

FIG. 9 is an enlarged fragmentary longitudinal cross-sectional view taken along line 9—9 of FIG. 2 showing mechanism operated by a single shaft and knob for connecting and disconnecting the drum in the machine;

FIG. 17 is a perspective view of certain parts of the mechanism;

FIG. 18 is an enlarged fragmentary view of FIG. 17 along line 18–18;

FIG. 19 is a fragmentary view of FIG. 5 with the side frame removed to show one of the brackets which supports the impression roll and showing three adjusted positions of the spring biasing means;

FIG. 22 is a fragmentary view of FIG. 5 showing the mechanism for supporting and moving one of the forwarding rollers, with the bight between the rollers being shown in open condition;

FIG. 23 is a fragmentary view similar to FIG. 22 but showing the bight between the rollers closed;

FIG. 24 is a plan view partly in section of the mechanism shown in FIGS. 22 and 23;

DESCRIPTION OF THE PREFERRED EMBODIMENT

Figure 3:
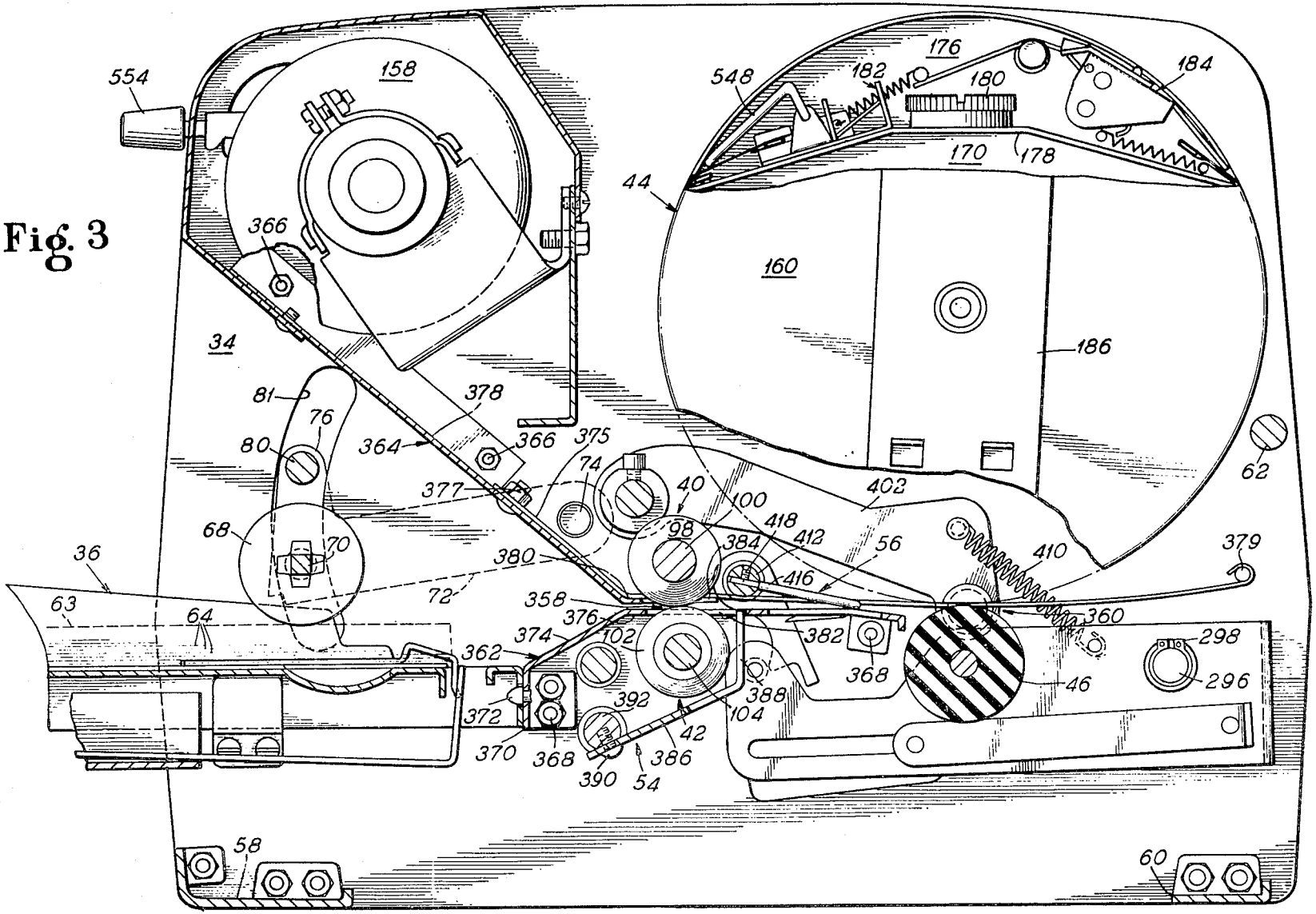
FIG. 3 is a partial vertical section taken on line 3—3 of FIG. 2.

The machine shown in the drawings comprises a housing 30 having a pair of side plates or frames 32 and 34; a feed table or tray 36 for supporting a stack 63 of copy sheets 64 in position to be advanced into the housing; feed means 38 for advancing sheets from the stack; a pair of relatively movable forwarding rollers 40 and 42 defining a first, variable bight 358 therebetween, a rotatable drum 44; an impression roll 46 movable relative to the drum and defining with the drum a second, variable bight 360; and guide means including lower and upper guide plates 362 and 364 and strippers 375 for guiding copy sheets along a path of movement from the tray through the first and second bights. Paper stop means 54 and paper sensing means 56 are disposed along the path of movement between the first and second bights.

Referring now in more detail to the above mentioned components and their cooperation in the machine, the side plates 32 and 34 are held in fixed spaced relationship by a number of rigid cross members bolted or otherwise fastened therebetween. These include transverse struts 58 and 60, rod 62, and other elements forming part of the housing.

The feed table 36 is shown and described in detail in Springer U.S. Pat. No. 3,417,988 issued Dec. 24, 1968 on "Sheet Guiding Mechanism". Briefly, it supports a stack 63 of copy sheets 64 at the input end in position to be advanced one at a time into the housing. The operation is automatic, the rate of feed being one sheet per each rotational cycle of the drum. At the output end of the machine is a receiving tray 66 to collect the printed sheets.

Feed means 38 comprises a pair of rubberlike feed wheels 68 slidable to different spacings along a shaft 70 for sheets of different widths. The ends of the shaft 70 are rotatably journaled in a pair of arms 72 which are pivoted for up and down swinging movement outside the respective side plates 32 and 34, about the aligned axes of two separate shafts 74. The arms 72 have upwardly offset sections 76 held by bolts 78 to the ends of a spacer rod 80. An arcuate slot 81 in each side plate provides clearance for the shaft 70 and rod 80 during up and down movements of the feed wheels 68.

Figure 5:
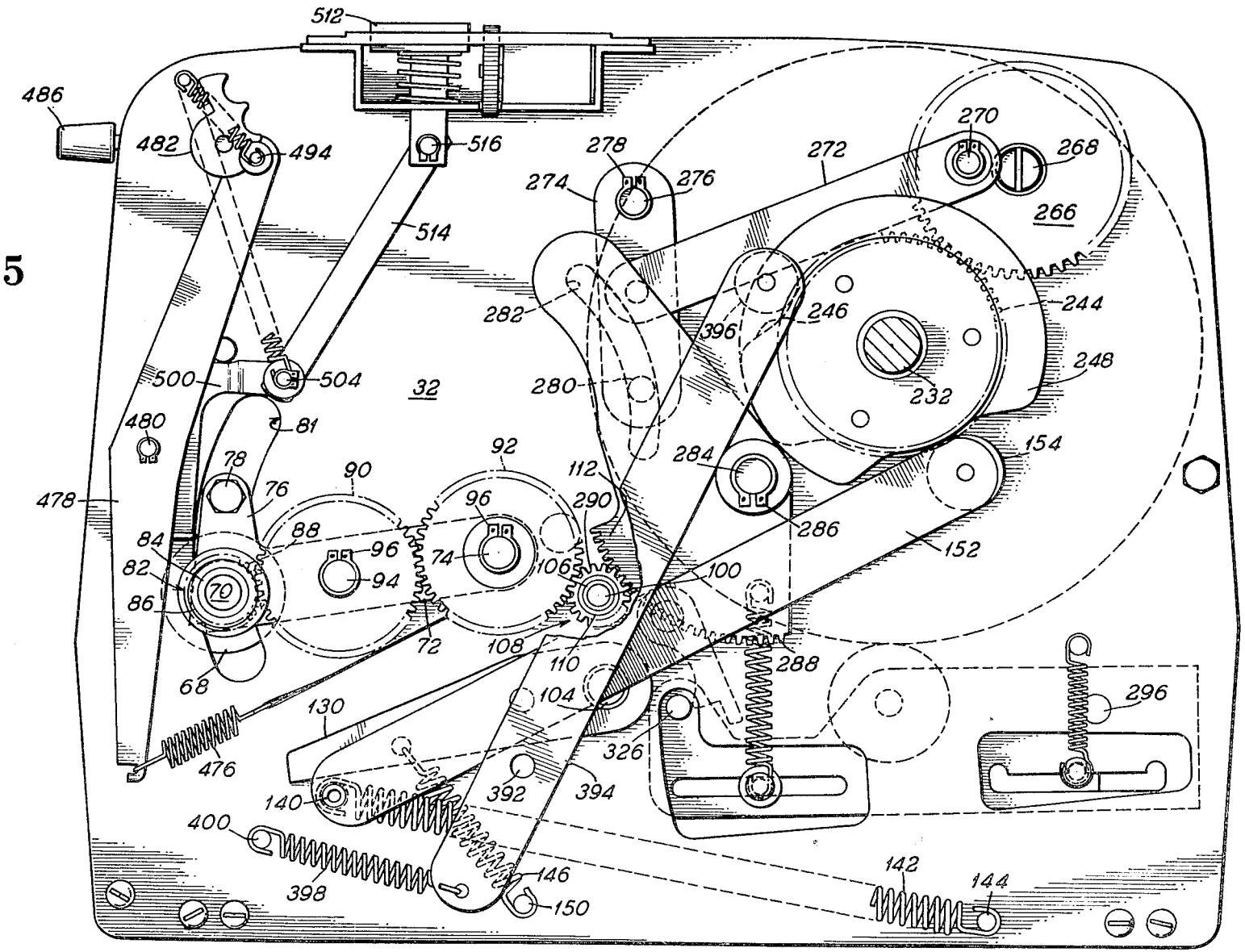
FIG. 5 is a side elevation of the driving and timing mechanism viewed along line 5—5 of FIG. 2, but with the respective ornamental cover removed.

As shown in FIG. 5, the end of shaft 70 adjacent the side plate 32 is connected through an overrunning clutch 82 to an outer race 86 having external gear teeth 88. An inner race 84 is fixed to shaft 70, and sprags (not shown) between the inner and outer races drive shaft 70 counterclockwise when the outer race rotates counterclockwise as seen in FIG. 5. The sprags overrun or free wheel when the outer race rotates clockwise.

The outer race 86 is rotatably driven by a train of gears 90 and 92 carried by the respective arm 72. Gear 90 is rotatable on shaft 94 which is mounted on arm 72 intermediate its ends. Gear 92 is rotatable on shaft 74. Both gears 90 and 92 are held in place by snap rings 96. Thus, it will be seen that the train of gears for driving feed wheels 68 swing vertically with pivotal movement of shaft 74, allowing the feed wheels to move down as the stack of sheets on the feed table is used up during operation of the machine.

The upper and lower forwarding rollers 40 and 42 have a series of rollers 98 and 102 on shafts 100 and 104 respectively.

The ends of shaft 100 are rotatably journaled in side plates 32 and 34. Externally of side plate 32, as shown in FIG. 5, shaft 100 is connected to an inner race 106 of an overrunning clutch 108. The outer race 110 has external gear teeth meshed with both gear 92 and gear sector 112. Sprags (not shown) between the inner and outer races enable the shaft 100 to be rotated by the outer race only in a counterclockwise direction as seen in FIG. 5. Clutch 108 overruns when its outer race rotates clockwise.

At the other end of shaft 100, exteriorly of side plate 34, there is a friction brake generally designated 114 (FIGS. 17 and 18). This comprises a flexible friction strap 116 having a riveted loop 118 anchored to a stub shaft 120 on the exterior of side plate 34. Strap 116 has a bend 122 tensioned about a flat cylindrical groove 124 at the end of shaft 100 by a spring 126 held by pin 128 on side plate 34. This holds the shaft 100 braked against rotation unless the shaft is positively driven by a torque sufficient to override the friction of strap 116 against the brake groove 124.

As best shown in FIGS. 22–25, the ends of lower forwarding roller shaft 104 are loosely rotatably journaled in bearings 128 carried by levers 130. The levers 130, together with the shaft 104, comprise a flexible actuated frame for supporting the annular roller elements 102. The loose journal connection represented by the clearance between each bearing 128 and shaft extension 129 (FIG. 25) comprises in effect a limitedly swivelable connection enabling the ends of the shaft 104 to move up and down independently of one another, within limits, thereby enabling the ends of the lower forwarding roller assembly 42 to press uniformly against the upper forwarding roller assembly 40.

Each lever 130 has an integral boss 131 at its midsection pivoted for rocking movement about a reduced end portion 133 of an actuating shaft 132. Each end portion of shaft 132 is rotatably journaled in a bushing 134 in one of the side plates 32 and 34. The shaft 132 comprises part of a rigid actuating frame including actuating levers 136 which are held by screws 138 to T-handle 139 fast to the reduced diameter extension 133. A washer 141 is provided between members 131 and 139.

Each lever 136 has an inwardly extending transverse pin 140 engageable edgewise with the end portion of the corresponding lever 130 opposite the end portion carrying the shaft 104.

A tension spring 142 is connected between pin 140 and an anchor pin 44 on side plate 32. This biases the rigid actuating frame (shaft 132 and levers 136) counterclockwise as viewed in FIGS. 22 and 23.

Two springs 146, both external of side plates 32 and 34, are connected between an anchor opening 148 in each lever 130 and an anchor pin 150 on side plate 32 or 34. Springs 146 exert a torque on the flexible actuating frame (shaft 104 and levers 130) urging the movable lower forwarding roller assembly 42 upward against the fixed upper forwarding roller assembly 40. Both the actuating and actuated frames referred to are thus biased counterclockwise (FIGS. 22 and 23) about the same shaft, namely shaft 132.

At the end of shaft 132 exteriorly of side plate 32 (FIG. 24) lever 136 has an opposite extension arm 152 with a follower roller 154 engageable with a cam for automatic operation to be described.

There is a lost motion relationship between levers 130 and 136 on both sides of the housing. This effectively enables the lower forwarding roller assembly 42 to be moved downward as a unit, but allows the ends of roller assembly 42 to seek their own positions when moved upwardly for the best, uniform engagement with roller assembly 40. This lost motion arrangement is best shown in FIG. 23. There, shaft 132 and lever 136 are rotated counterclockwise sufficiently to disengage pin 140 from the lower edge 156 of actuated arm 130. This, of course, would be true on both sides of the machine. Because the shaft 104 and levers 130 comprise a limitedly flexible frame, each spring 146 moves each corresponding lever 130 in a direction to close the first bight 358, between the rollers 40 and 42, on each side of the machine as shown in FIGS. 3 and 23. When the integral actuator arm 152 and lever 136 are rocked clockwise about the axis of shaft 132, both pins 140 will engage the under edges 156 of arms 130, rotating the latter clockwise (FIGS. 22 and 23) about the shaft 132 and opening the bight between rollers 40 and 42. This opened bight is shown in FIG. 22.

Returning now to the description of the synchronized drive mechanism for the feed wheels 68 and forwarding rollers 40 and 42, the drum 44 is driven by a motor 158. As shown in FIGS. 7, 8 and 9, the drum, in turn, then drives the feed wheels and forwarding rollers.

The drum 44 comprises a pair of circular ends or heads 160 and a partially cylindrical peripheral wall 162 having apertures 164. An open mesh screen 166 covers the wall portion 162 and, as will be described, provides an auxiliary, cylindrical ink reservoir immediately beneath an ink pad 168 for instant access of ink thereto. Such auxiliary ink reservoir receives ink through the apertures 164 from a main ink reservoir 170 within the drum.

The apertured cylindrical wall section 162 shown in FIGS. 7 and 8 is the printing portion of the drum which supports the ink pad 168 and a stencil 547. Between the leading edge 172 and the trailing edge 174 (FIG. 10) of the cylindrical printing segment 162, there is a recess 176 defined by an ink retaining wall 178 having a threaded cap 180 through which ink is put in the main reservoir 170. The recess 176 also contains ink pad clamp means 182 and stencil clamp means 184 both of which will be described in detail.

Each drum end or head 160 has a generally rectangular reinforcing plate 186 (FIGS. 7, 8 and 9) affixed thereto as by soldering or brazing. Plates 186 are parallel and each has an outer eccentric lug 188 and a pair of circumferentially spaced lugs 190 disposed closer to the rotational axis of the drum. As will be described, there is a lug 188 at each end of the drum. These provide convenient temporary anchor points for a carrying bail, to move the drum back and forth between the machine and a separate storage stand. The two pairs of lugs 190 at opposite ends of the drum 44 provide means for transmitting torque between the drum 44 and supporting members 218 and 236, and they enable initial, positive alignment of the drum 44 and supporting members 218 and 236 along their common rotational axis before they are connected together, and thereby make it possible to rapidly connect and disconnect the drum within the machine. To avoid inadvertent reversal of the drum within the machine, the opposite pairs of lugs 190 may be located at different radial distances from the center.

Referring to FIG. 9, an axial sleeve or tube 192 is soldered or brazed between the ends 160 of the drum. Within the sleeve is an axially shiftable shaft 194 and an internally threaded bushing 196 which is fixed in position by soldering or brazing to the interior surface of sleeve or tube 192. The shaft has an inner extension 198 of sufficiently reduced diameter to clear the threaded bore of bushing 196. A guide washer 200 is supported on the extension 198 and is slidable within the bore of sleeve 192. A coil spring 202 is compressed between an internal snap ring 204 in a groove at one end of the sleeve 192, and an external snap ring 206 in a groove on shaft 194. The spring biases the shaft 194 to the right (FIG. 9), toward a position wholly contained between the ends of the sleeve 192.

The mechanism for supporting the drum 44 between the side plates 32 and 34 will now be described.

A supporting and driving tube 208 is rotatably journaled within a sleeve bearing 210 in side wall 34. A drive pulley 212 is fastened to the supporting tube 208 in any suitable manner as for example by the set screw 214. A flanged hub 216 is fastened to the end of supporting tube 208 interiorly of the side plate 34, by solder or a press fit. A disc-like supporting member 218 is fastened to the hub 216. An alignment and driving member 220 is fastened as by rivets 222 to the inside surface of supporting member 218. As best shown in FIG. 7, the member 220 is T-shaped, having radially outwardly facing ledges or shoulders 226 for supporting the lugs 190 to axially align the drum sleeve 192 with the supporting tube 208. Lugs 190 are spaced sufficiently to straddle the rib or stem portion 224 of the T-shaped member 220 and thereby provide an effective rotatable driving connection between the supporting disc member 218 and the drum.

A second supporting and driving tube 228 (comprising a substantial counterpart of supporting tube 208) is rotatably journaled within a sleeve bearing 230 fixed within side plate 32. A center shaft 232 is rotatably with supporting tube 228 and has an end bore 233 positioned to receive the outer end portion 264 of shaft 194 when extended as shown in FIG. 9.

A flanged hub 234 (similar to 216) is fastened to the inner end of center shaft 232 and is rotatable with that shaft and with supporting tube 228 in normal operation. A disc-like supporting member 236, which may be identical with member 218, is connected to the flanged hub 234 and rotatable therewith. A T-shaped locking member 220 and lugs 190, as described above for the other end of the drum, provide a releasable, rotatable driving connection between the supporting disc member 236 and the drum. A cam 238 is fastened to and rotatable with the sleeve 228. Cam 238 moves the impression roll 46 relative to the drum by mechanism which will be described.

By a worm and pinion means not forming part of the present invention, and therefore not shown, the tube 228 and 232 are rotatably adjustable to vary the cam 238 relative to the drum. This raises or lowers the printing on the copy sheets in response to rotation of adjusting discs 239 on wheel 241 (FIG. 1).

Externally of the side plate 32 a drive bushing 240 is fastened to the supporting tute 228 by a set screw 242. Fastened to the drive bushing 240 and rotatable therewith is a drive gear 244 and cams 246 and 248. As will be described, cam 246 moves the paper stop means 54, and cam 248 (fastened to 246 by spacer rivets 250) moves forwarding roller 42.

As shown in FIG. 3, the power source for the machine is the motor 158. This is connected through a suitable speed reducing power transmission (not shown) to drive pulley 212 shown in FIG. 9. Optionally, for a more simplified, less automatic version of the machine, one of the tubes 208 and 228 may be turned by a hand operable crank not shown.

Thus, rotation of tube 208 by the drive pulley 212 (or the optional crank) rotates supporting drive disc member 218. This rotates the drum and the other supporting drive disc member 236 through the two sets of T-shaped locking members 220 and lugs 190. Disc 236 drives tube 228 and the parts rotatable therewith including drive gear 244 and cams 246 and 248.

Having described the parts for supporting the drum, the means operated by a single handle for quickly connecting and disconnecting the drum between the sideframes will now be described.

Refer again to FIG. 9. A shaft 252 having a reduced diameter outer extension 254 is rotatable, and axially slidable, within supporting tube 208. A knob or handle 256 is held by a set screw 258. A snap ring 260 in an internal groove in tube 208 retains the shaft 252.

At its extreme inner end, shaft 252 has an externally threaded reduced diameter extension 262, adapted to be screwed into bushing 196 as shown in solid lines in FIG. 9.

To disconnect the drum, the knob 256 need only be rotated sufficiently to disconnect threaded extension 262 from threaded bushing 196. Then, by drawing the handle 256 outwardly from the tube 208 until the outer shoulder of shaft 252 engages the snap ring 260, the threaded inner end portion 262 will be moved to the broken line position shown in FIG. 9, disconnecting the right end of the drum at hub 216. As the shaft end 262 moves away from the extension 198 of shaft 194, the latter will shift automatically to the right (FIG. 9) until its outer end 264 is recessed within the end of the drum as shown in broken lines. This releases the left end of the drum at hub 234. Then, with the drum rotated so the locking members 220 are upward, the drum can be lifted straight upward, free of the machine.

Conversely, the drum 44 (or another drum with different colored ink) may be assembled quickly by lowering the drum into position for engagement of the lugs 190 with the locking members 220, followed by pressing the shaft 252 inward and turning handle 256 to engage the screw threads in members 196 and 262.

When the shaft 194 is completely retracted by the spring 202 into the drum, the reduced diameter inner end 198 is positioned slightly to the right of the threaded bushing 196. This is shown in broken lines in FIG. 9. This permits initial inward movement of the shaft 252 to engage the end 198 of shaft 194 and shift the opposite end 264 into bore 233 in shaft 232 before the threads in members 262 and 196 are engaged. The assembly can then be moved to the solid line locked position shown in FIG. 9 by only one or two subsequent turns of the knob 256.

By the foregoing, the drive from motor 158 to the drive gear 244 has been described. The driving connections from gear 244 to the sector 112 will now be described to complete the driving train for the machine.

Drive gear 244 rotates crank gear 266 about pin 268 fastened to side plate 32. Crank pin 270 is connected by lever 272 to the midpoint of lever 274 which rocks back and forth about pin 276 fastened to side plate 32. Lever 274 is held to pin 276 by snap ring 278. At the free end of lever 274 a pin 280 is engaged with an arcuate slot 282 in sector 112. The sector is rockable about a pin 284 fastened to side plate 32 and a snap ring 286 holds it in place.

The sector has an arcuate line of gear teeth 288 meshed with gear teeth 290 on the outer race 110 of overrunning clutch 108 which has previously been described.

Cyclic rotation of feed wheels 68 and forwarding roller 40 may now be summarized as follows. Rotation of crank gear 266 causes crank lever 272 to rock lever 274 back and forth. This alternately rocks gear sector teeth 288 clockwise, and counterclockwise, about shaft 284. Because of the overrunning clutches 82 and 108, previously described, counterclockwise movement (FIG. 5) of sector 112 rotatably drives the feed wheels 68 in a counterclockwise direction to feed the top sheet 64 from the stack on the feed table 36; at this time, the clutch 108 is overrunning and therefore not driving the forwarding rollers. Next, when sector 112 rocks in a clockwise direction, overrunning clutch 108 drives the upper forwarding roller in a counterclockwise direction to further advance the sheet toward the drum. These separate advancing movements of the sheet by the feed wheels and forwarding rollers are synchronized with operation of the other parts of the mechanism as will be described.

As shown in FIGS. 17 and 19, the impression roll 46 is carried by a shaft 292 having its opposite ends respectively journaled in brackets 294, 294 which are independently pivotable about stub shafts 296 extending inwardly from side plates 32 and 34. The detailed construction of the mounting enabling the ends of the shaft 292 to be rotatably journaled in the brackets 294, yet sufficiently pivotal to enable the brackets to move up and down independently, is best shown in FIGS. 17, 19, 20 and 21 and will be described subsequently.

Each bracket 294 has an elongated body portion 320 and an out-turned flanged portion 322. The body portion has a pivot opening 324 engaging pivot shaft 296, and a catch pin 326 on the outer side of the bracket at the end remote from pivot shaft 296. Each bracket has interrupted elongated slot means consisting of a pair of horizontal, aligned slots 328 and 330, the latter having three detent notches 332, 334 and 336 in the upper edge.

An adjustment member 338 is manually movable lengthwise along each bracket to vary the pressure of the impression roll against the drum. Each adjustment member includes an elongated body portion 340 and an inturned grip portion 342 and each has a pair of pins 344 and 346 engageable respectively within the slots 328 and 330. The pins have enlarged heads 348 to keep them within the slots.

A tension spring 350 is connected between pin 344 and an anchor pin 352 on the adjacent side plate 32 or 34. Similarly a tension spring 354 is connected between pin 346 and an anchor pin 356 on each side plate. As shown in FIGS. 17 and 19, the lines of action of springs 350 and 354 extend substantially parallel to the vertical planes of movement of the brackets 294. Further, the lines of action of these springs are transverse to the lines of adjustment movement of the adjustment members 338.

In the embodiment disclosed, the adjustment members 338 are movable to three different torque positions to select three degrees of pressure of the impression roll against the drum. When pins 346 are in notches 336, the lines of action of the springs 350 and 354 will be at a maximum distance from the pivot pin 296, and the combined upward pull of the springs to exert torque to the brackets and press the impression roll toward the drum will be at the maximum. When pins 346 are in middle notches 334, as shown in solid lines in FIG. 19, the lines of action of the springs will be somewhat closer to the pivot shaft 296, and the torque on the brackets and the upward pressure of the impression roll against the drum will be at an intermediate value. When pins 346 are in notches 332, the line of action of spring 354 will be on the opposite side of pivot shaft 296 (see FIG. 19) so that only springs 350 will exert any effective torque and upward pressure on the impression roll. Thus, each adjustment member 338 is movable between a maximum torque position where pin 346 is seated in notch 336, and a minimum torque position where pin 346 is seated in notch 332.

An important feature of the machine is the mechanism enabling the impression roll 46 to be connected quickly and easily into the machine, or to be disconnected therefrom. This is best shown in FIGS. 17, 19, 20 and 21.

The impression roll comprises a resilient cylindrical cover 351 concentrically mounted on shaft 292. The ends of shaft 292 have reduced diameter extension 353 and 355. A snap ring retainer or stop 357 is provided in a groove at the end of each extension. Sleeve bearing members 359 and 361, which may be identical, and each having an external flange 363, are slidably mounted on extensions 353 and 355, respectively. A coil spring 365 on extension 353 is seated between a shoulder 367 and the flange of bearing member 359, biasing the latter in an outward direction. At the other end of shaft 292, a rotatable washer 369 is interposed between shoulder 371 and the flange of bearing member 361.

Figure 20:
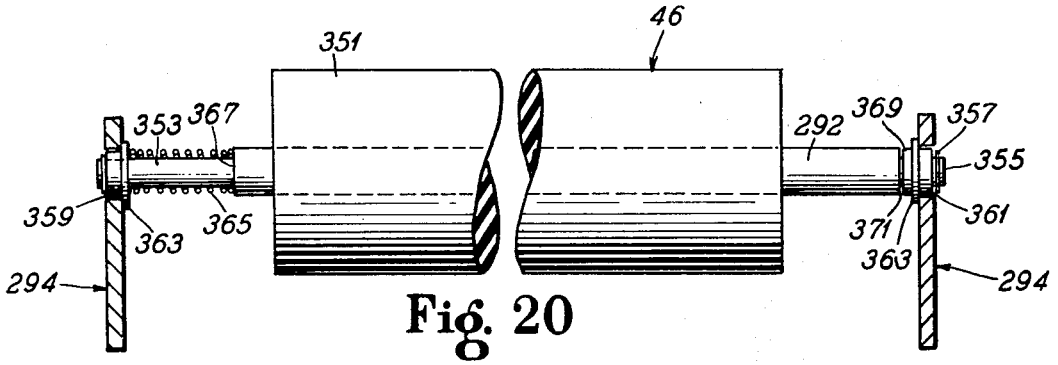
FIG. 20 is an enlarged sectional view of FIG. 19 taken along line 20–20.

In operating position, the impression roll 46 is asembled with bearings 359 and 361 seated within openings 373 in the brackets 294 as shown in FIG. 20.

Figure 21:
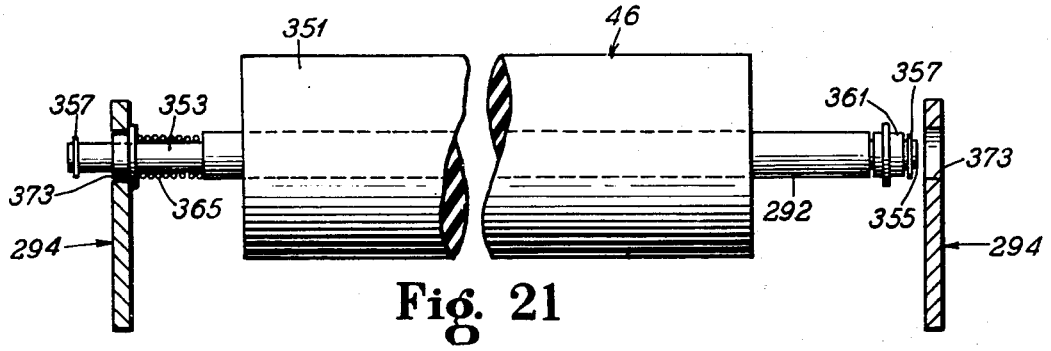
FIG. 21 is a view similar to FIG. 20 showing the impression roll partially disconnected.
Figure 25:
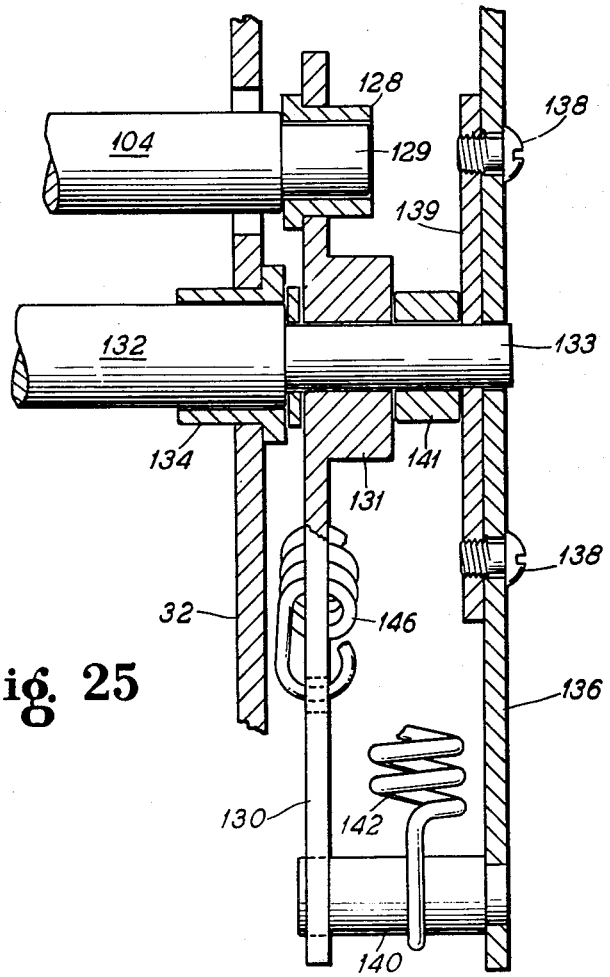
FIG. 25 is an enlarged view of a portion of FIG. 24.
Figure 26:
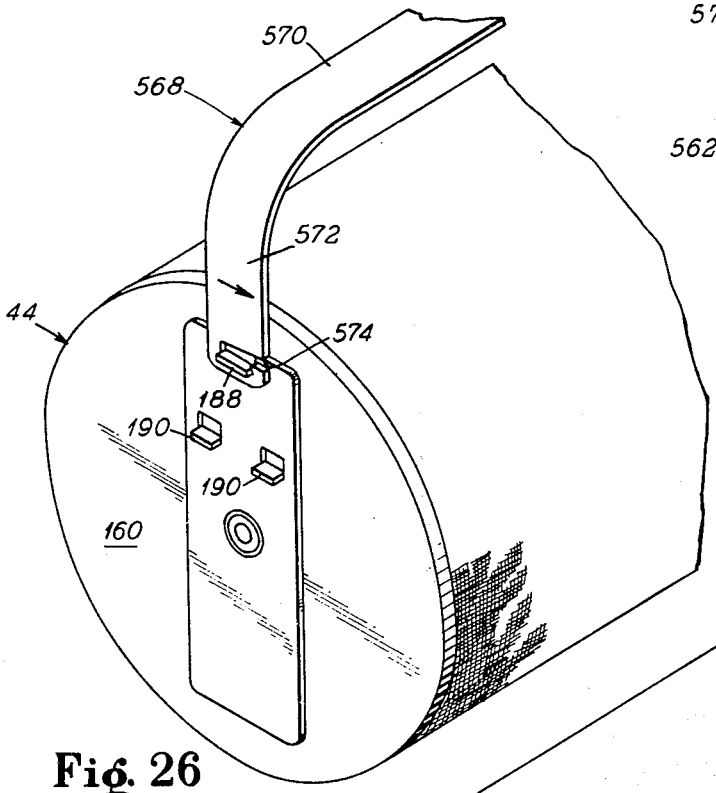
FIG. 26 is a perspective view showing the drum connected to a removable carrying bail for transfer to a storage stand.

To disconnect the impression roll 46 from the machine, the operator simply grasps the roll and presses it in a direction to compress spring 365 thereby withdrawing bearing 361 from opening 373, as shown in FIG. 21. So released, the impression roll may simply be pivoted about its remaining engaged end and swung out of the machine. The snap ring retainers 357 function as stops to limit outward movement or loss of the bearing members when the impression roll is removed from the machine.

As described, it is important that the brackets 294 be free to pivot independently, to the extent that opposite ends of the impression roll will be pressed uniformly against the drum. The ends of the shaft 292 must, of course, rotate within the bearings 359 and 361 and the bearings must allow for limited pivotal movement of the ends of the shaft relative to the brackets. This is provided simply and practically in the present invention by making the clearances between the bearings and the shaft, and between the bearings and the brackets large enough to allow such combined rotational and pivotal movement.

As shown in FIG. 3, guide mechanism is provided for guiding copy sheets 64 successively along a path of movement from the stack 63 on the feed table 36 to the first bight 358 (between the forwarding rollers) and then to the second bight 360 (between the impression roll and the drum). This guide mechanism includes lower and upper supporting and guide plates 362 and 364. The guide plates extend between the side plates 32 and 34 and have transverse flanges fastened thereto by bolts 366 and 368.

The lower supporting and guide plate 362 includes a vertical wall 370 with studs 372 for engaging the feed table 36, an upwardly inclined wall 374, and a lower horizontal wall 376 extending along and below the path of movement of the sheets. The upper supporting and guide plate 364 includes a downwardly inclined wall 378 and an upper horizontal wall 380 extending along and above the path of movement of the sheets. Horizontal wall portions 376 and 380 have openings 382 and 384 for the individual follower roller elements 102 and 98 respectively.

Figure 10:
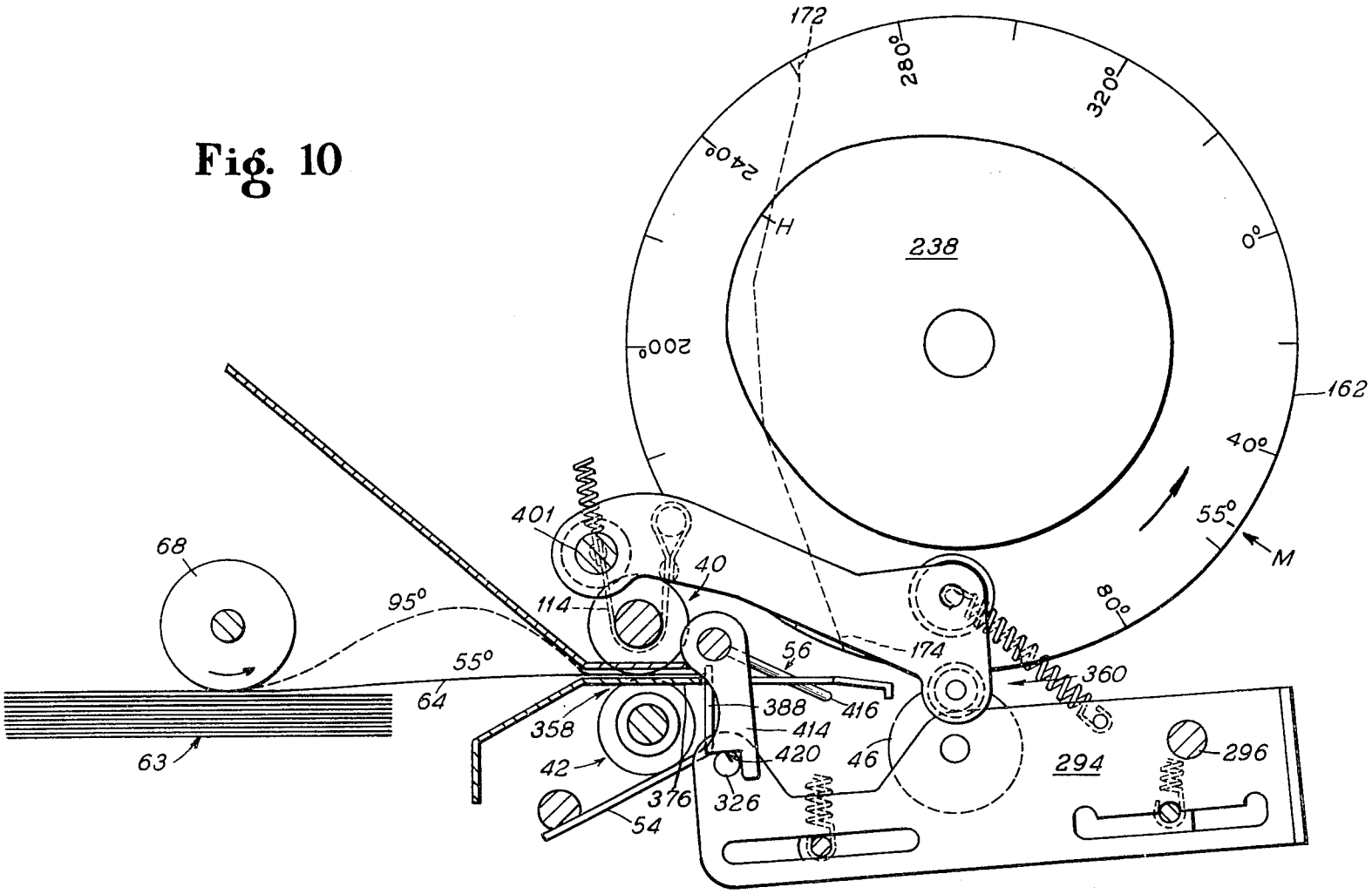
FIG. 10 is a sectional elevational view taken generally along line 10—10 of FIG. 2, with certain parts removed showing the relationship of certain components as a copy sheet is fed forward to begin the printing cycle.

The paper stop means generally designated 54 comprises a transversely extending plate having an upwardly inclined portion 386 terminating in vertical fingers 388 which extend through openings in the lower horizontal guide wall 376 when in their fully raised position. (FIG. 10). The stop plate is fastened as by screws 390 to rock shaft 392 which is pivoted between the side plates 32 and 34.

As best shown in FIG. 5, a paper stop actuating lever 394 is connected to rock shaft 392 externally of the side plate 32. The upper end of lever 394 has a follower roller 396 engageable with cam 246 already described in connection with FIG. 9. The lower end of lever 394 is connected by a spring 398 to an anchor pin 400 on side plate 32 and biases the lever 394 in a clockwise direction to keep follower 396 engaged with the cam 246.

Another important part of the invention is spring-type paper stripper means functioning as an extension of the upper supporting and guide plate 364. This feature is best shown in FIGS. 2 and 3.

As shown in FIG. 2, the axial length of the drum 44 exceeds that of the impression roll 46. A pair of transversely spaced, flexible strips 375 of material such as spring steel are fastened by bolts 377 to the top of the inclined wall 378. The strips 375 extend in an outward direction over the end of the upper horizontal guide wall 380, tangent to the bottom of the drum as shown in FIG. 3, to anchor pins 370 on the side frames. Thus, the stripper strips 375 will positively guide a sheet to the drum and then positively strip it from the bottom of the drum as it passes beyond the second bight by reason of the fact that the strips 375 extend continuously from the end of horizontal guide wall 380 to a position well beyond the second bight 360.

Each axial end portion of the drum has a peripheral ring 381 providing a slightly raised circumferential surface engaging the strips 375 and keeping them out of wearing engagement with a stencil on the drum.

An important feature of the strips 375 is that because they are mounted on top of and substantially "upstream" of the edge of horizontal guide wall 380, they continuously engage the edges of a copy sheet to, through, and beyond the second bight. This guides the sheet to the drum, and positively strips it from the drum after printing.

Mechanism will now be described for moving the impression roll 46 toward and away from the drum and for holding the impression roll out of contact with the drum when the machine operates without paper passing through it.

A rigid actuating frame, generally U-shaped and designated 399 (FIG. 17) is interposed between the single cam 238, (previously described in connection with FIG. 9) and the two independently movable brackets 294. The rigid actuating frame consists of a countershaft 401 pivotally journaled in side plates 32 and 34, and a pair of actuating arms 402 which extend toward the brackets 294. Each arm 402 has a lower roller 404 engageable with the top edge 406 of a corresponding bracket. One of the arms 402 has a follower roller 408 engageable with cam 238 previously described in connection with FIG. 9. A tension spring 410 (FIGS. 3 and 17) hold the rollers 404 engaged with bracket edges 406. This promotes quiet operation.

Because the actuating frame 399 is rigid, downward movement of either arm 402 is accompanied by identical movement of the other arm. Thus, in spite of the fact that both brackets 294 are independently movable to promote uniform upward pressure of the impression roll against the drum, booth ends of the impression roll will be moved simultaneously downwardly from the drum when the high portion H of cam 238 engages follower roller 408.

The part of the mechanism which holds the impression roll 46 out of contact with the drum in the absence of a copy sheet will now be described. A latch shaft 412 is pivotally journaled between the side plates 32 and 34. A pair of identical catch levers 414 are mounted at the ends of the latch shaft. Paper sensing means 56 comprise radial fingers 416 carried by latch shaft 412 intermediate its ends.

The paper stop fingers 388 and the paper sensing fingers 416 are both along the path of movement of the copy sheets between the first and second bights as shown in FIG. 3.

Figure 14:
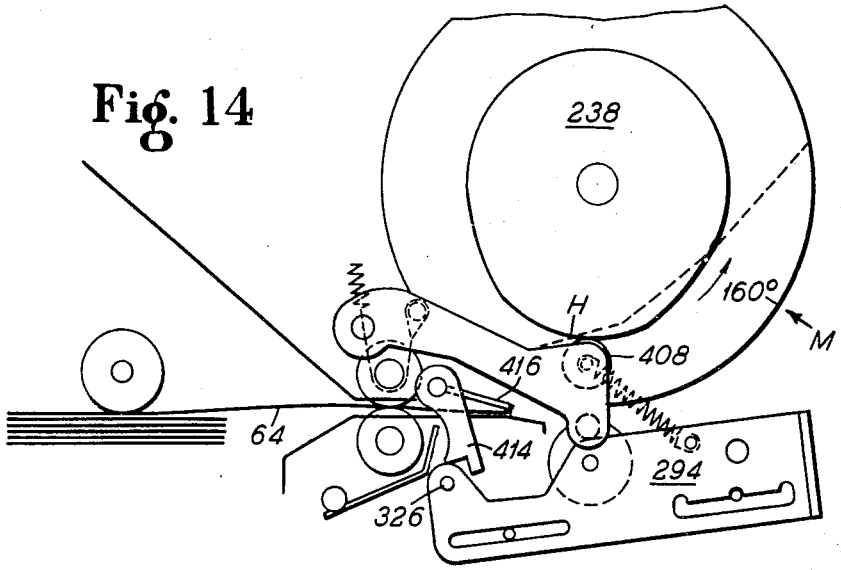

The latch shaft 412 is pivotable between a latching position and an unlatching position. In the latching position shown in FIGS. 10 and 17, the catch levers are swung to a substantially vertical position with their notches 420 engaging bracket catch pins 326 to hold the brackets 294 in position to keep impression roll 46 out of contact with the drum. In the unlatching position, shown for example in FIGS. 14, 15 and 16, the catch levers 414 are swung free and enable the spring-urged brackets to move the impression roll upward and press a copy sheet against a stencil on the drum.

Ornamental covers 422 and 424 (FIG. 1) are provided to cover the mechanism above described which is on the external surfaces of the side plates 32 and 34.

A hand wheel 241 is connected with supporting tube 228 (by means not shown) and adjusting wheel 239 may be rotated in one direction or the other and (by means not shown) may rotate shaft 232 relative to supporting tube 228 to advance or retard the cam 238 relative to the supporting disc 236. This is no part of the present invention so will not be described in detail, but, briefly, this adjustment raises or lowers the location of printing on the copy sheet, as previously described.

An important part of the invention, facilitating the uniform distribution of ink over the copy sheet at high speeds is the open mesh screen 166 (FIG. 8) which is stretched permanently about the apertured, cylindrical peripheral wall portion 162 and comprises an integral part of the drum. This communicates via apertures 164 with the main interior ink reservoir 170 inside the drum. As the drum rotates ink is distributed over the inside of the wall 162 and passes through the apertures 164 into the interstices of the open mesh screen 166 which constitutes in effect a continuous cylindrical auxiliary reservoir externally of the wall 162.

The ink pad 168 will preferably have a flannel side fitted with the nap extending into the screen 166 and with an exterior fine weave surface of material such as nylon or silk. Thus, by capillary action of the nap fibers extending into the auxiliary reservoir, namely the screen 166, ink would be transferred rapidly and uniformly to the outer surface of the pad 168. This greatly inhibits "dotting" which occurs at high speeds with conventional drums having the ink pad directly on the apertured peripheral wall 162. This "dotting" effect results where ink cannot flow to the pad areas between apertures 164 as readily as it flows through the areas directly over the apertures.

The ink pad 168 may be assembled quickly and easily on the screen 166 utilizing the improvements of the present invention as follows.

Refer now to FIGS. 4 and 4A. The drum has an eye 430 fastened as by rivets 434 to each of the heads 160 within the recess 176. Only one eye 430 is shown, this being on the head illustrated in FIG. 4 and at the top of FIG. 4A. These are near the leading end 172 of the cylindrical printing area 162. At the other end of the recess 176, adjacent the trailing end 174 of the cylindrical printing area 162 an angle member 436 is fastened, by a pair of bolts or rivets 438 attached to the floor plate 178. The base plate 440 of angle member 436 is supported above the floor plate 178 by washers 439 which are seated on the floor plate 178 and which encircle the bolts or rivets 438. A second angle member 442 is movable in the clearance between base plate 440 and floor plate 178. This movable second angle member 442 has a base plate 444 which is slidably retained in the above-mentioned clearance between plates 440 and 178. Grooves 443 in the base plate 444 engage the washers 439 and guide the base plate for right and left movement as seen in FIG. 4A. A leaft spring 446 is riveted to the center of movable base plate 444 and has upwardly inclined portion 448 extending through central openings 452 and 453 in upstanding webs 441 and 445, respectively. A small upstanding detent button 450 is movable with the angle member 442 between the solid line position of FIG. 4A and the broken line position indicated on that same figure. By grasping the two webs 442 and 445 between his thumb and finger, the operator can squeeze the two together, moving the angle member 442 to the dotted line position shown in FIG. 4A. In this position the detent button 450 snaps into the broken line position shown, behind web 441 holding the two parts together while the ink pad is connected or disconnected. Two springs 454 connect the ends of angle member 442 to ears 456 on the heads 160. These springs urge the angle member 442 to the right, that is to the solid line position shown in FIG. 4A, when the spring 446 is manually depressed by the operator. Each end of the angle member 442 has an ink pad hook 458, and serves as a releasable ink pad anchor.

Ink pads 168 are provided conventionally with loops 460 and 462. In FIGS. 4 and 4A, these loops are shown respectively adjacent the leading and trailing edges of the drum printing area. To connect such a pad to the drum of the present invention a flat metal rod 464 is threaded through loop 460. The ends of the rod which protrude from the sides of the pad will be inserted within the openings 432 in eyes 430. The pad is then pulled taut about the cylindrical, peripheral wall 162 with its flannel or nap side against the screen 166, as above described. A second flat rod 466, similar or identical to 464, will be threaded through the other loop 462. Then, with the angle member 442 in its retracted position shown in broken lines, the ends of the rod 466 will be inserted into hooks 458. Then, the operator will press spring portion 448 to release detent button 450 from web 441. Springs 454 will then pull the ink pad and maintain it taut.

Figure 6:
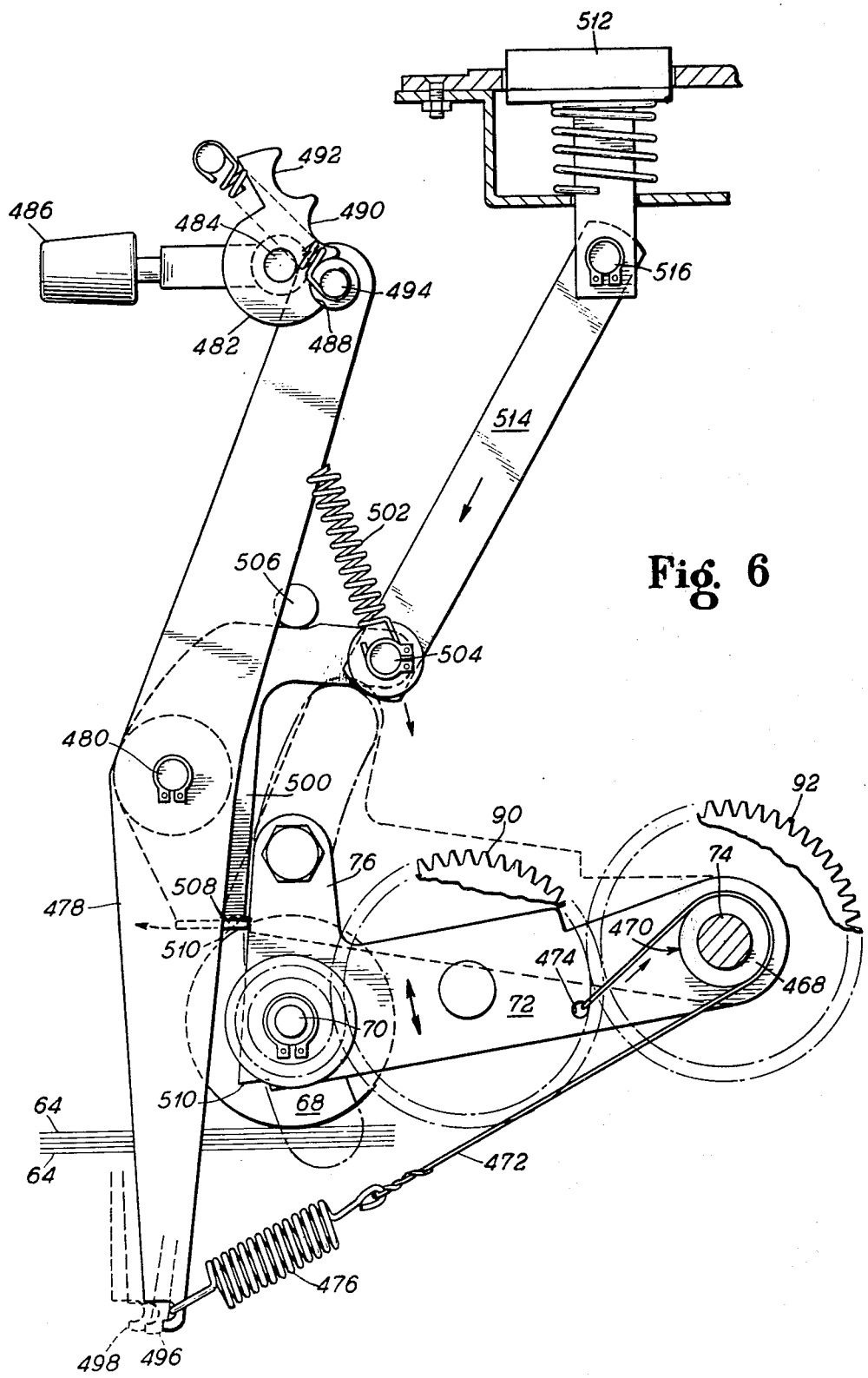
FIG. 6 is an enlargement of a portion of FIG. 5.

Refer now to FIGS. 5 and 6 which show the feed tension control employed for varying the pressure of the feed wheels on the stack of copy sheets on feed table 36. Heavy paper requires a higher feed pressure than light paper.

As previously described, the feed wheels 68 and their supporting shaft 70 are rotatably supported above the feed table by a frame including a pair of spaced arms 72. The frame is pivotably mounted on the housing about the axis of a pair of aligned stub shafts 74. The arm 72 on the side of the machine adjacent side plate 32 has a hub 468. The periphery 470 of the hub comprises a circumferential strand guide surface. This surface extends about and is, of course, spaced from the common axis of pivot shafts 74.

A flexible strand such as a small diameter steel or nylon cable 472 is wrapped one or more times about the guide surface 470 and is anchored to the arm 72 in an opening 474. The other end of the strand is fastened to a spring 476 which, in turn, is hooked to the lower end of an adjustment lever 478. Thus, the strand 472 is trained about the guide surface 470 in such a direction, that, when tensioned by the spring 476, it exerts a torque on the arm 72 which tends to lift the frame and reduce the weight of the feed wheels and frame on the stack. An intermediate portion of the adjustment lever 478 is pivoted about pin 480 on the side plate 32. An adjustment cam 482 is mounted on rock shaft 484 which is journaled on the housing and is pivotable by a manually operable lever 486. The cam 482 has a plurality (in this case three) of notches 488, 490 and 492 which are at different distances from the shaft 484 and are selectively engageable with a follower pin 494 at the upper end portion of the lever 478.

When the cam notch 488 engages pin 494 as shown in FIG. 6, lever 478 will be in the solid line position shown, applying minimum tension to strand 472 through the spring 476. This places minimum torque on the arms 72, enabling substantially full weight of the frame and feed wheels to be applied to the top copy sheet 64 in the stack. When the adjustment cam 482 is successively rotated to engage the pin 494 within notches 490 and 492, the lower end of lever 478 will assume the broken line positions shown respectively at 496 and 498. This progressively increases tension in spring 476 and strand 472 to apply increasing lifting forces on the feed wheel frame. The pressure of the feed wheels, on the top sheet is less at notch 490, and even less at notch 492.

A latch 500 is pivoted to the housing about the pin 480. It is biased in a counterclockwise direction against a stop 506 by a spring 502 connected between side plate 32 and a pin 504, which provides a pivotal connection between latch 500 and a link 514. When so biased against the stop 506, a lower outward flange 508 is engageable with a lower notch 510 on arm 72, and in this position can hold the feed wheels 68 up, out of engagement with the stack 63. This up-latched position is used when the machine is out of operation or the feed table is being loaded.

A manually operable release button 512 is guided on the housing for straight up and down, rectilinear motion. Link 514 is pivoted at pin 516 on the button 512 and provides a flexible connection whereby rectilinear motion of the button 512 results in pivotal movement of the latch 500.

Upward movement of the feed wheel frame automatically moves the latch 500 aside and the extension 508 will snap into supporting position into notch 510 at the underside of arm 72. In dropping the feed wheels onto the stack, only light downward pressure on the button 512 is required to disengage flange 508 from the notch 510.

The stencil clamp means generally designated 184 will now be described. See FIGS. 4 and 4A.

This includes main and auxiliary clamps 518 and 520. The main clamp is a pivoted take on plate, receiving the first engagement of the impression roll 46; it has down-turned end portions 522, each of which is rotatable about a main pivot screw 524. This enables the clamp 518 to be pivoted outward to the open, broken line position shown in FIG. 4. The pivoted clamp or take on plate 518 has a knife edge 526 which functions as a tear guide for a stencil. A formed wire main spring 528 encircles a pin 530 and has opposite ends engaged respectively with the underside of clamp 518 and a pin 456. Pins 530 and 456 are fixed to the inner side of one or both of the heads 160. The underside of the clamp 518 is provided with a hook bar 534, fastened by rivets 535 to the end portions 522. Four stencil engaging hooks 536 are fastened to the underside of the bar.

The auxiliary clamp or stencil plate 520 has a pair of inwardly extending arms 538 pivoted to the main clamp 518 by auxiliary pivot pins 540. One or more coil springs 542 are connected between the main and auxiliary clamp plates and urge the latter about the pivot pins 540 toward the position shown in FIG. 4 where it lies substantially flat-wise atop the main clamp. The auxiliary clamp 520 is grooved at four locations as indicated at 544 to register with stencil head engaging studs 546.

In operation, the apertures at the head end of a stencil may be attached either to the hooks 536, or to the studs 546, as desired.

To attach a stencil 547 to the hooks 536, the main clamp 518 will be pivoted outward to its broken line position (FIG. 4) and then lowered with the knife edge 526 pressed firmly against the stencil cover sheet which may then be torn off across it. The stencil, with the cover sheet removed, will then be stretched tautly about the ink pad 168 on the drum and the tail end of the stencil will be retained beneath the formed wire clamp 548 which is pivoted between brackets 550 at opposite ends of angle 436. A torsion spring 552 presses clamp 548 down into closed position on the stencil as shown in FIG. 4.

To attach a stencil sheet to the studs 546, the auxiliary clamp 520 will be pivoted outward about the pins 540, against the pull of springs 542, without moving the main clamp 518 from its solid line position shown in FIGS. 4 an 4A, until there is room to insert the head end portion of the stencil sheet in the space between the clamps. The holes in the stencil sheet which are standard, elongated, keyhole-shaped openings, engage the studs. The two arms 538 are at opposite ends of the drum and their leading edges 539 are spaced apart a distance narrower than the width of a standard stencil sheet. As shown in FIGS. 4 and 4A this enables the leading edges 539 of the arms 538 to intersect the plane of a stencil sheet overlying the outer surface of main clamp 520. These leading edges 539 intersect the plane of a stencil sheet so positioned along a line *x—x* (FIG. 4A) which is parallel to the axis of the drum.

USE AND OPERATION

Use and operation of the machine will now be described in connection with FIGS. 10 to 16 which show various operating positions of the parts.

As shown in FIG. 10 the drum periphery has been arbitrarily marked in degrees at forty degree increments. The leading end 172 of the apertured cylindrical portion 162 of the drum is at approximately 258° and the trailing end is at approximately 135°. The high part of impression roll actuating cam 238 starts at approximately 160° and ends at approximately 300°; the highest part of the cam is between approximately 200° and 260°; the high point is at approximately 228° and is marked H.

It will be appreciated that the parameters given are only by way of illustration and not by way of limitation. The mark M has no significance except that it is a convenient location to mark the position of the drum.

To prepare the machine for operation, ink is placed in the main reservoir 170 through the screw cap 180. A stack 63 of copy sheets 64 will be placed on the feed table 36. The drum will have an ink pad 168 and a stencil 547 fitted as above described. Motor switch handle 554 will be turned to "ON" position, energizing motor 158 and rotating drum 44 through the transmission including pulley 212. Lever 486 will be moved to select the desired pressure of the feed wheels 68 upon the stack. Button 512 will be pressed to drop the feed wheels onto the top sheet 64. When feed lever 556 is moved to "ON" position, a clutch (not shown) will engage gears 90 and 92 rotating feed wheels with each counterclockwise (FIG. 5) swing of sector 112, and rotating forwarding roller 40 with each clockwise swing of sector 112.

Operation of the machine during one complete rotation of the drum is as follows:

At 0° (not illustrated), according to the drum markings shown in FIG. 20, the feed wheels 68 begin to rotate counterclockwise. Lower forwarding roller 42 is held down by cam 248, so the first bight 358 is open. The paper stop fingers 388 are down. And, assuming previous revolutions of the drum were without paper the brackets 294 are latched down by the catch levers 414 engaging catch pins 326, thereby holding the second bight 360 open.

At 15° (not illustrated), cam 246 starts to move paper stop fingers 388 upward and this is completed at 40°.

At 55° (FIG. 10), the sheet 64 is stopped by fingers 388, and starts to buckle. Further rotation of the feed wheels 68 continue to buckle the sheet until it reaches the 95° maximum buckle position which is shown in broken lines in FIG. 10.

Between 80° and 100° (not illustrated) forwarding roller 42 is raised to close the first bight. Immediately thereafter, between 100° and 120°, the stop fingers 388 drop by a forward and downward movement below the bottom horizontal wall 376.

Figure 11:
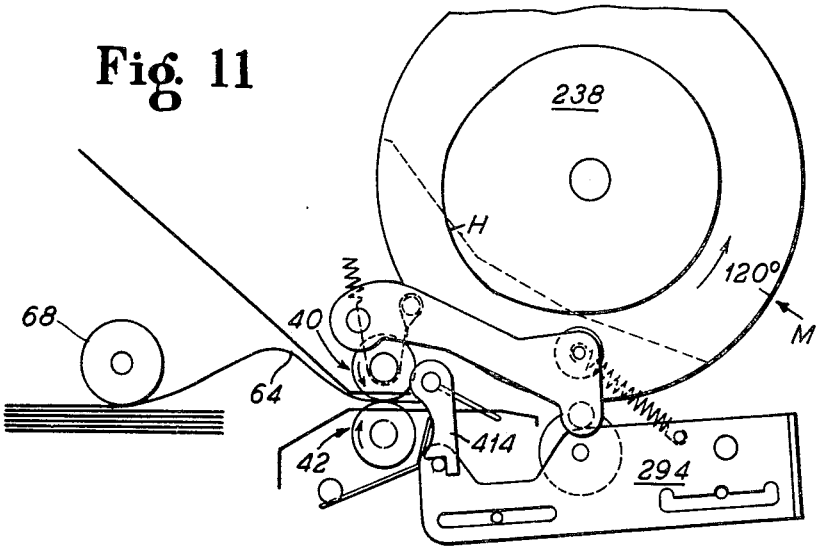
FIGS. 11–16 are schematic views similar to FIG. 10 but on a reduced scale showing subsequent operative positions of components as the copy sheet is advanced through the machine.
Figure 12:
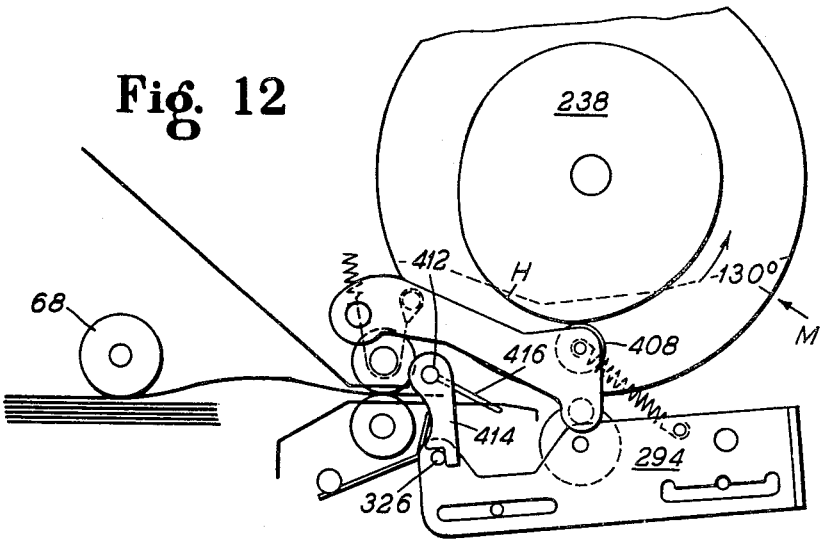

An important part of the invention is that while the stop fingers 388 are being moved out of the path of movement of the sheet, the forwarding rollers 40, 42 are pinched and held unrotatable by friction brake 114, positively maintaining during this interval the precise position of the leading edge portion of the sheet which had been obtained by abutting the copy sheet against the stop fingers 388. FIG. 11 shows the parts at 120°. The feed wheels 68 are non-driven; the forwarding rollers 40, 42 are closed and just starting their driving condition as the sector 112 starts to swing clockwise about pin 284; the brackets 294 are still latched in their down position by catch levers 414; and the copy sheet 64 is beginning its advance toward the second bight.

At 130° (FIG. 12) the forwarding rollers continue closed and continue to advance the sheet toward the drum; the high part of cam 238 just begins to engage the follower 408 and to press both brackets down to free both catch levers 414 from frictional engagement with catch pins 326.

Figure 13:
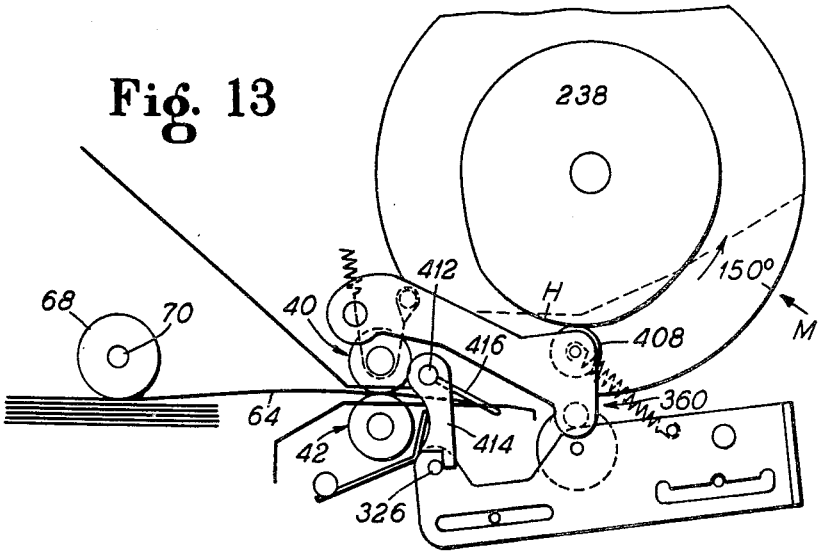

At 150° (FIG. 13) the forwarding rollers 40, 42 continue closed and continue to advance the sheet toward the drum. Catch levers 414 and their rock shaft 412 remain released from the bracket catch pins 326 and are dead free to rotate under the relatively small pressure of a sheet 64 moving against the paper sensing fingers 416. At this time the leading edge of the sheet 64 has just reached the approximate midpoint of the fingers 416 and are starting to swing the catch levers 414 in a counterclockwise direction as shown in FIG. 13. The second bight 360 is still held wide open because the high portion of the cam 238 presses the follower 408 downward. Although the trailing end portion of the sheet 64 is still beneath the feed wheels 68, the shaft 70 overruns in clutch 82 enabling the forwarding rollers 40, 42 to pull the sheet from the stack with little resistance.

At 160° (FIG. 14) catch levers 414 are swung away, clear of the catch pins 326, by engagement of the leading end of sheet 64 with the paper sensing fingers 416. At that moment, brackets 294 are held down, and the second bight open, by substantially full engagement of the high part of cam 238 with the follower roller 408.

At 175° (FIG. 15) the forwarding rollers remain closed and positively drive the copy sheet into the second bight which is still held open by the cam 238. At this time, the sheet leading edge reaches the still-open second bight.

At 180° (not illustrated) the high point of the cam 238 passes the follower roller 408, and brackets 294 start moving up to close the second bight.

Figure 16:
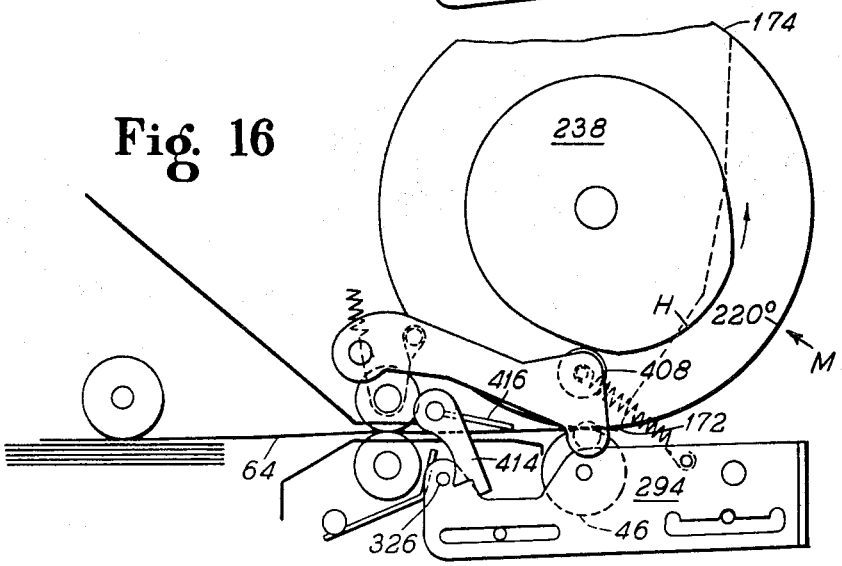

At 220°, as shown in FIG. 16, the cam 238 is nearly disengaged from the follower roller 408. The impression roll 46 has engaged the underside of the sheet 64, the leading end of which is now beyond the second bight. The leading end portion 172 of the printing drum has now just passed the second bight, so printing can begin throughout the entire length of the stencil to the trailing end 174 of the printing portion of the drum.

The above cycle will be repeated as long as a copy sheet 64 is advanced to the paper sensing fingers 416 and thence to and through the second bight 360.

Figure 15:
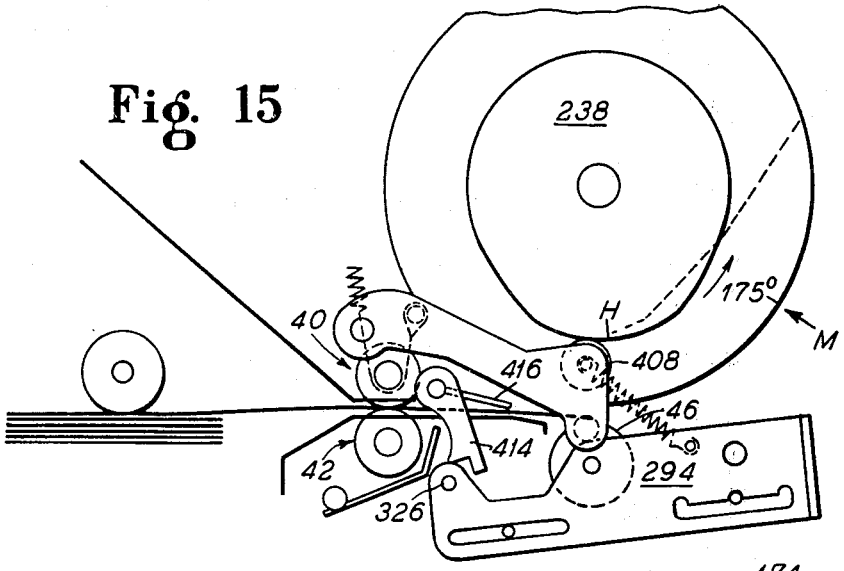

When the supply of copy sheets 64 runs out, or if for some other reason a sheet does not reach the paper sensing fingers 416 during the 150°–160° range of the drum (see FIGS. 13 and 14), the cam 238 will open the second bight wide (as shown in FIG. 15) and the catch levers 414 will swing into engagement with the catch pins 326 because there is no paper against fingers 416 to hold the catch levers open. This enables the machine to continue cycling, but without fouling the impression roll 46 by moving it up against the ink-covered stencil.

An important feature of the present invention is the ease with which a drum can be removed and stored close at hand and replaced by another having different colored ink, without the operator having to touch one of the ink-covered drums with his hands. This is best illustrated in FIGS. 7 and 26–29.

A storage stand 558 is provided to support a drum 44 out of the machine. The stand comprises a base 560 and a pair of spaced, vertical support arms 562 upstanding from the base. Each of the arms terminates at its upper end in a pair of upwardly facing, horizontal shoulders 564, and a rib 566 extending upwardly therebetween. The width and spacing of shoulders 564 are substantially the same as for shoulders 226 on the corresponding T-shaped members 220. Likewise, the width of rib 566 is substantially the same as that for rib 224 on the T-shaped members 220. The heights of the arms 562 may be made slightly different to compensate for any different placements of the lugs 190 on the ends of the drum. Thus, any drum which fits in the machine on shoulders 226 will be supported on their substantial counterparts, shoulders 564 on arms 562.

A bail 568 (FIG. 26) has a horizontal handle 570 with a pair of vertical arms 572, each with a horizontal slot 574 having an open side. The bail can be hooked onto the opposite two lugs 188 by horizontal movement in the direction of the arrow shown in FIG. 26, and can be released by horizontal movement in the opposite direction.

Figure 27:
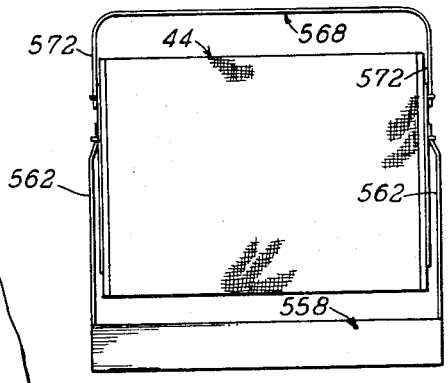
FIG. 27 is a view of the bail and drum supported on a storage stand remote from the duplicating machine.
Figure 29:
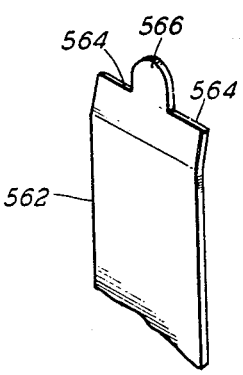
FIG. 29 is a fragmentary view of FIG. 28 showing the details of the shoulder and rib arrangement for supporting the drum.
Figure 28:
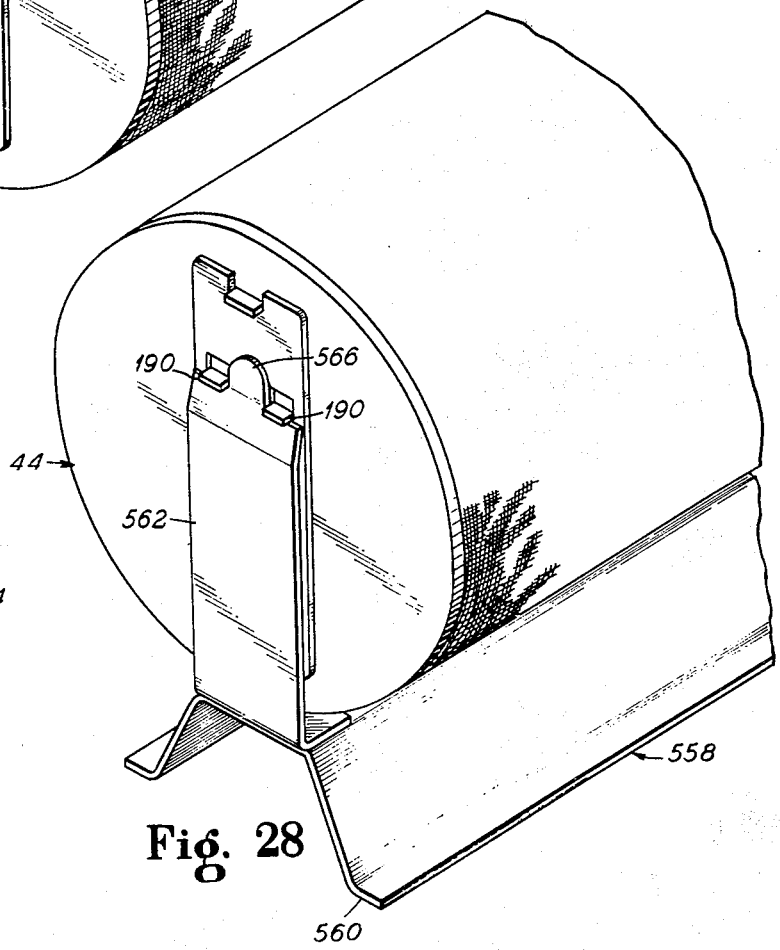
FIG. 28 is a fragmentary perspective view of the drum supported on the storage stand.

To remove a drum having one color ink, and store it on the stand 558, while using another drum with different colored ink, or when merely removing the drum temporarily to clean the machine, the drum is first rotated to the position where the T-members 220 are in their upper position as shown in FIGS. 7 and 9. The handle 256 is then rotated to release the threaded extension 262 from the bushing 196 and moved outward to place the shaft 252 in its retracted position. Shaft 194 automatically retracts under the urgence of spring 202. This releases both ends of the drum from the disc supporting members 218 and 236. By hooking bail 568 onto the lugs 188, which are uppermost, the drum is lifted straight out of the machine (FIG. 26) and is placed straight down into stand 558 as shown in FIGS. 27 and 28. Another drum can then be placed in the machine if desired, merely by reversing the above described procedure.

While one form in which the present invention may be embodied has been shown and described, it will be understood that various modifications may be made within the spirit and scope of the invention which should be limited only by the appended claims.

The embodiments of the invention in which an exclusive property or privilege is claimed are defined as follows:

1. In a duplicating machine having a rotatable printing drum comprising a cylindrical segment adapted to support a stencil, and a peripheral recess between the leading and trailing edges of the cylindrical segment and the ends of the drum, apparatus for gripping the apertured head end of a stencil sheet comprising:

a take on plate in said recess having an ascending outer surface which increases in distance from the drum axis toward and terminates adjacent the leading edge of said cylindrical segment, said surface having a first section adjacent said leading edge which is initially engageable with an impression roll to guide said impression roll over said leading edge onto said cylindrical segment, said surface having a second section remote from said leading edge with a series of stencil aperture engaging studs thereon, said studs being disposed within said recess closer to the drum axis than said first section enabling an impression roll to engage said first section while clearing said studs;

means for removably fastening the apertured head end portion of a stencil sheet to said studs in a position where it is protected against ink-staining and automatically alignable with the drum axis, said means including a stencil plate mounted on arms at opposite ends of the drum spaced apart a distance less than the width of a standard stencil sheet, said arms having leading edges abuttable, along a line parallel to the axis of said drum, edgewise with the head end edge of a stencil sheet engaged with said studs, said arms being pivotally supported within said recess about an offset axis located radially inwardly from said take on plate, whereby pivotal closing movement of said stencil plate about said offset axis is characterized by radially inward movement of said stencil plate to press the head end portion of the stencil sheet onto said take on plate and by simultaneous edgewise movement of said arms against the head end edge of the stencil sheet to automatically align said head end edge of the stencil sheet with the drum axis.

2. In a duplicating machine, the combination of claim 1 in which said stencil plate is apertured to receive said studs.

3. In a duplicating machine, the combination of claim 1 in which the inner surface of said stencil plate is simultaneously below the upper ends of said studs when said stencil plate arms engage the head end edge of the stencil sheet, whereby the stencil sheet is positively held on the studs while it is being aligned by said arms.

4. In a duplicating machine, the combination of claim 1 in which the stencil plate when closed onto said take on plate is offset forwardly from the leading edge of the cylindrical segment to expose a portion of said take on plate for engagement with an impression roll independent of the stencil plate.

* * * * *

UNITED STATES PATENT OFFICE

CERTIFICATE OF CORRECTION

PATENT NO. : 3,941,054

DATED : March 2, 1976

INVENTOR(S) : Edward M. Springer

It is certified that error appears in the above-identified patent and that said Letters Patent are hereby corrected as shown below:

Col. 3, line 40 - After "therebetween" insert -- ; --

Col. 6, line 65 - Change "rotatably" to -- rotatable --

Col. 7, line 21 - Change "tute" to -- tube --

Col. 11, line 2 - Change "370" to -- 379 --

Col. 12, line 63 - Change "leaft" to -- leaf --

Col. 12, line 65 - After "has" insert -- an --

Col. 13, line 3 - Change "442" to -- 441 --

Col. 16, line 4 - Change "20" to -- 10 --

Signed and Sealed this

Sixth Day of July 1976

[SEAL]

*Attest:*

RUTH C. MASON
*Attesting Officer*

C. MARSHALL DANN
*Commissioner of Patents and Trademarks*